US011619198B1

(12) United States Patent
Leu et al.

(10) Patent No.: US 11,619,198 B1
(45) Date of Patent: Apr. 4, 2023

(54) FUEL SUPPLY SYSTEM AND RELATED METHOD FOR ENGINES

(71) Applicant: Kohler Co., Kohler, WI (US)

(72) Inventors: James G. Leu, Keil, WI (US); Joshua Bledsoe, Fond du Lac, WI (US); Digambar Govardhan Patil, Maharashtra (IN)

(73) Assignee: Kohler Co.

( * ) Notice: Subject to any disclaimer, the term of this patent is extended or adjusted under 35 U.S.C. 154(b) by 0 days.

(21) Appl. No.: 17/743,750

(22) Filed: May 13, 2022

(51) Int. Cl.
*F02M 37/04* (2006.01)
*F02M 39/02* (2006.01)
*F02M 37/00* (2006.01)

(52) U.S. Cl.
CPC ..... *F02M 37/046* (2013.01); *F02M 37/0047* (2013.01); *F02M 39/02* (2013.01)

(58) Field of Classification Search
CPC ... F02M 37/0047; F02M 37/046; F02M 39/02
USPC ..... 123/73 AF, 73 C
See application file for complete search history.

(56) References Cited

U.S. PATENT DOCUMENTS

| | | | | |
|---|---|---|---|---|
| 2,175,624 | A | 10/1939 | Wood | |
| 3,179,054 | A | 4/1965 | Arndt et al. | |
| 3,556,687 | A | 1/1971 | O'Connor | |
| 3,987,774 | A | 10/1976 | Waag | |
| 4,168,288 | A | 9/1979 | Nau et al. | |
| 4,338,904 | A | 7/1982 | Brinkman | |
| 4,539,949 | A | 9/1985 | Walsworth | |
| 4,846,118 | A * | 7/1989 | Slattery | F02M 59/107 123/73 AD |
| 5,000,134 | A | 3/1991 | Fujimoto | |
| 5,279,504 | A | 1/1994 | Williams | |
| 5,419,686 | A | 5/1995 | Wissmann et al. | |
| 5,560,345 | A | 10/1996 | Geyer et al. | |
| 7,775,194 | B2 | 8/2010 | Kono et al. | |
| 10,197,004 | B2 | 2/2019 | Pursifull et al. | |

FOREIGN PATENT DOCUMENTS

| | | | |
|---|---|---|---|
| CN | 201363256 | Y | 12/2009 |
| DE | 3817766 | A1 | 12/1988 |
| EP | 1146224 | A1 | 10/2001 |
| FR | 2298700 | A1 | 8/1976 |

* cited by examiner

*Primary Examiner* — Hai H Huynh
(74) *Attorney, Agent, or Firm* — The Belles Group, P.C.

(57) ABSTRACT

An engine apparatus includes a fuel supply system which may comprise a fuel reservoir, primary fuel supply path extending from a fuel inlet in fluid cooperation with the fuel reservoir to a fuel outlet, pressure pulse source, and first and second pressure-operated fuel pumps located along the primary fuel supply path; each of fuel pumps operably coupled to the pressure pulse source. The fuel pumps may be pulse type pumps arranged in series from a flow standpoint along the primary fuel supply path such that fuel discharged by the first fuel pump is supplied to the second fuel pump. The fuel pumps may be mounted and to the engine or appurtenance thereof in a stacked or side-by-side relationship. The pressure pulse source may be the engine crankcase in some designs. The flow and pressures delivered by the series flow fuel pumps are suitable for use with four stroke/cycle engines.

20 Claims, 30 Drawing Sheets

FUEL SUPPLY SYSTEM AND RELATED METHOD FOR ENGINES

BACKGROUND

The present disclosure is related to internal combustion engines, and more particularly to a fuel supply system thereof and related method.

Fuel supply systems for some internal combustion rely on a single fuel pump. The pump takes suction from the fuel reservoir or tank and delivers a specific flow or volume of the liquid fuel at a specific pressure to the engine cylinder or cylinders for combustion. One type of fuel pump used for two stroke/cycle engines is pulse type pump. These diaphragm-actuated pumps use the changing air pressures inside the crankcase of the engine to pump fuel as the pistons move up and down in the engine cylinders. Pulse type fuel pumps are mechanically simple and therefore less expensive than other types of fuel pumps from an initial cost standpoint.

While the relatively large differential pressures produced in the crankcase of smaller two stroke/cycle engines is typically sufficient to meet the fuel flow and pressure requirements for such engines, the same is not true for the crankcase of larger four stroke/cycle engines. The smaller differential pressures in the crankcase of larger four stroke/cycle engines is insufficient to use a single pulse type fuel pump to meet the fuel flow and pressures needed to operate these larger engines. Four stroke/cycle engines therefore generally require more costly mechanical fuel pumps operated off the cam shaft of the engine. Accordingly, not all four stroke/cycle engine designs heretofore could use and take advantage of lower cost pulse type fuel pumps.

Improvements in fuel supply systems for internal combustion engines are desired.

BRIEF SUMMARY

The present disclosure in one aspect provides a liquid fuel supply system for an internal combustion engine which can meet the fuel flow and pressure requirements of a four stroke/cycle engine. In one implementation, the fuel supply system may comprise a pair of diaphragm-actuated pressure-operated fuel pumps of the pulse type which collectively deliver fuel from the fuel reservoir such as a fuel tank at the desired flow and pressure requirements of larger displacement four stroke/cycle engines. The dual fuel pumps are operated off differential pressures produced in the engine crankcase which may provide the pressure pulse source. To compensate for the lower crankcase pressures of larger four stroke/cycle engines, the pulse type fuel pumps may be arranged in series along the primary fuel supply path in certain flow arrangements (i.e. fuel outlet of first pump is fluidly coupled to fuel inlet of second pump). Advantageously, for certain engines and operating load conditions, the inventor has found that the series flow arrangement provides greater fuel flow rates and pressures than what a single pulse type pump alone could deliver, thereby making a pair of pulse type pumps usable for larger horsepower four stroke/cycle engines. In one implementation, the engine disclosed herein for use with serial pulse type fuel pumps may be a four stroke/cycle engine greater than 25 horsepower.

In one mounting option, the fuel pumps of the pulse type may be mounted directly or indirectly to and supported by the engine body or engine appurtenance coupled to the engine along a common mounting axis in a closely coupled and stacked arrangement or assembly to minimize the length of inter-pump fuel exchange flow conduits such as hoses or tubing. In other mounting options as may be required by certain engine equipment layouts, the pumps may be mounted in a side-by-side relation along two separate mounting axes. In either of these mounting arrangements, the pumps may still be fluidly interconnected in a serial flow fashion. The dual fuel pumps may be detachably coupled directly to the engine body or various appurtenances or parts associated with and supported directly or indirectly by the engine (e.g., cylinder block, baffles/shrouds, crankcase, etc.). In other mounting arrangements, the dual fuel pumps may be mounted to one or more separate pump mounting brackets attached in turn to the engine or engine-related appurtenances. Numerous variations in the mounting arrangements are possible so long as the pumps are fluidly connected in series from a fuel flow standpoint.

The pulse type fuel pumps disclosed herein may operate to pump fuel from the fuel tank using the alternation of negative (vacuum) and positive air pressures created within engine crankcase as the pistons move up and down, as previously noted. The term "pressure pulse" as used herein connotes pulses which may be positive and negative (vacuum) pressures in nature. The flexible diaphragms within the fuel pumps are exposed to alternating positive and vacuum pressure signals as the pistons reciprocate in the engine cylinders. This causes the diaphragms to oscillate back/forth to draw fuel into the pump from the fuel supply (e.g., reservoir or tank), and discharge the liquid fuel. Specifically, the diaphragm draws or intakes fuel into the pump on its upward stroke and pushes or expels fuel out of the pump on its downward stroke. Internal check valves within the pumps are configured to prevent fuel from flowing backward through each pump.

Pulse hoses fluidly couple the crankcase to each of the pulse pumps such that each pump sees a negative pressure or vacuum signal simultaneously, and a positive pressure signal simultaneously. Accordingly, the paired fuel pumps each operate in unison to draw fuel inward at the same time, and discharge fuel form each pump at the same time. The upstream pump discharges fuel to the downstream pump, whereas the downstream pump discharges fuel to a fuel metering device fluidly coupled to the engine, such as without limitation a carburetor or electronic fuel injection pump either of which supply the fuel to the engine cylinders.

In one aspect, an internal combustion engine apparatus comprises: a fuel reservoir; a primary fuel supply path extending from a fuel inlet in fluid cooperation with the fuel reservoir to a fuel outlet; a pressure pulse source; first and second pressure-operated fuel pumps located along the primary fuel supply path, each of first and second pressure-operated fuel pumps operably coupled to the pressure pulse source; and the first and second pressure-operated fuel pumps arranged in series along the primary fuel supply path such that fuel discharged by the first pressure-operated fuel pump is supplied to the second pressure-operated fuel pump. The pressure pulse source may be a crankcase. The pressure-operated pumps may be air-actuated pulse pumps. The pumps may be supported directly or indirectly by the engine body in stacked or side-by-side relationship.

In another aspect, an internal combustion engine comprises: an engine body; a fuel reservoir; a pressure pulse source; first and second pressure-operated fuel pumps operably coupled to the pressure pulse source and configured to deliver fuel from the fuel reservoir to a carburetor or a fuel injector pump; and the first and second pressure-operated fuel pumps supported directly or indirectly by the engine body.

In another aspect, an internal combustion engine comprises: a fuel reservoir; a crankcase chamber experiencing pressure pulses; and at least one pressure-operated fuel pump operably coupled to the crankcase chamber by one or more pressure pulse conduits, the one or more pressure pulse conduits sloped so that carryover oil carried into the one or more pressure pulse conduits drains by gravity back into the crankcase chamber.

In another aspect, a method of supplying fuel to a carburetor or fuel injector pump of an internal combustion engine comprises: a) generating pressure pulses in a chamber of the internal combustion engine by operating the internal combustion engine; and b) operating first and second pressure-operated fuel pumps utilizing the pressure pulses in the chamber to supply fuel from a fuel reservoir to the carburetor or fuel injector pump. The first and second pressure-operated fuel pumps operate in phase with one another in response to the pressure pulses.

BRIEF DESCRIPTION OF THE DRAWINGS

The present invention will become more fully understood from the detailed description and the accompanying drawings, wherein like elements are labeled similarly and in which.

Figure 1:
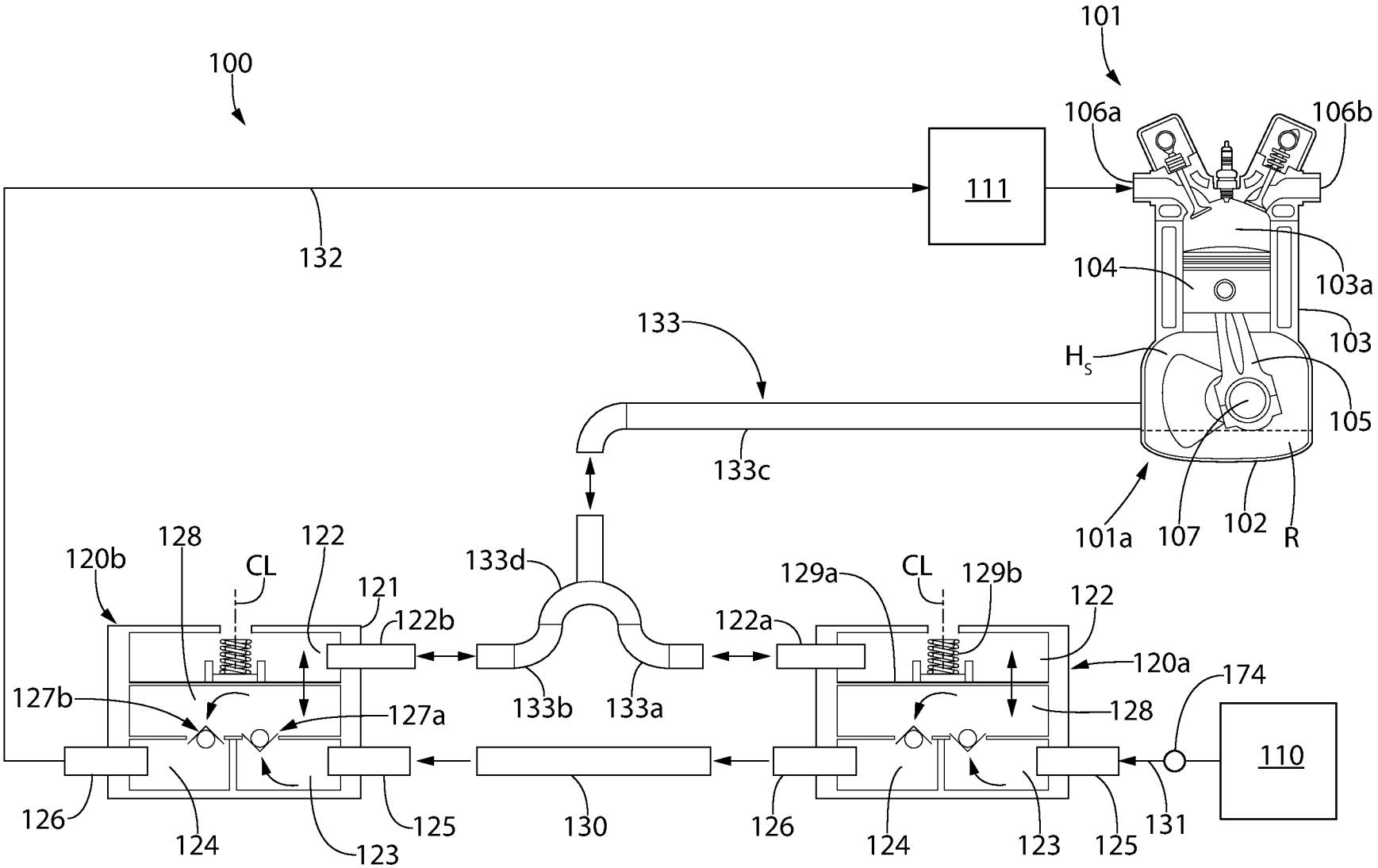
FIG. 1 is a schematic flow diagram of a fuel supply system for an internal combustion engine with dual pulse-type fuel pumps arranged in series flow according to the present disclosure.

All drawings are schematic and not necessarily to scale. Features or items shown numbered in certain figures which may appear un-numbered in other figures are the same features or items unless noted otherwise herein.

DETAILED DESCRIPTION

The features and benefits of the invention are illustrated and described herein by reference to non-limiting examples in which aspects of the disclosure may be embodied. This description of examples is intended to be read in connection with the accompanying drawings or photos, which are to be considered part of the entire written description. Accordingly, the disclosure expressly should not be limited to such examples illustrating some possible non-limiting combination of features that may exist alone or in other combinations of features disclosed herein.

In the description of examples disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIG. 1 is a schematic flow diagram of a fuel supply system 100 with dual pulse-type fuel pumps according to the present disclosure for an internal combustion engine 101. Engine 101, which is schematically depicted, has a body 101*a* defining a crankcase 102 defining an oil chamber and cylinder block 103 defining a plurality of engine cylinders 103*a*, plurality of pistons 104 movable in a reciprocating manner within the cylinders, fuel inlets 106*a* which supply fuel to each cylinder, and exhaust gas ports 106*b* which expels the combusted air/fuel mixture from each cylinder. Each piston is coupled to the crankshaft located in the crankcase by a connecting rod 105 such that the pistons alternatingly reciprocate up and down in the cylinders as the crankshaft rotates. The crankcase holds a reserve R of lubricating oil which lubricates the crankshaft and connecting rods as they move. An air space such as headspace Hs is formed in the crankcase chamber above the reserve of oil located in the bottom region of the crankcase. Some oil vapor may exist in the headspace HS above the oil level at certain operating conditions.

The diaphragm-actuated, pressure-operated pulse-type fuel pumps (alternatively referenced to herein as simply "pulse pumps" for brevity) are fluidly interconnected and arranged in series flow relationship from a fuel flow standpoint as shown. The pulse pumps include a first upstream pulse pump 120*a* and second downstream pulse pump 120*b*. Each pump may be identical in some implementations with respect to the pump product in construction, design, and fuel delivery specifications (e.g., discharge fuel flowrate and pressure). In other implementations, the pumps may be different. Suitable commercially-available pulse pumps or custom designed pulse pumps may be sourced from various pump manufacturers to the present fuel supply system.

Each pulse pump 120*a*, 120*b* generally includes a pump body or housing 121, internal air pressure chamber 122, fuel inlet 125 fluidly coupled to an internal inlet fuel chamber 123, fuel outlet 126 fluidly coupled to an internal outlet fuel chamber 124, an intermediate primary fuel chamber 128 fluidly interposed between the inlet and outlet fuel chambers. Housing 121 may be formed of any suitable metallic or non-metallic material such as plastic. Inlet fuel chamber 123 may be fluidly coupled to primary fuel chamber 128 by an inlet check valve 127*a* which prevents fuel from flowing back into the inlet fuel chamber from the primary fuel chamber. In similar fashion, outlet fuel chamber 124 may be fluidly coupled to primary fuel chamber 128 by an outlet check valve 127*b* which prevents fuel from flowing back into the primary fuel chamber from the inlet fuel chamber.

The air pressure chamber 122 of each pulse pump 120*a*, 120*b* is fluidly coupled by a pressure pulse conduit such as pulse hose or tube 133 to a pressure pulse source. The headspace Hs inside the engine crankcase 102 may be the pressure pulse source in one implementation. In one implementation, pulse tube 133 may have a branched configuration comprising single main pulse tube section 133*c* fluidly coupled to crankcase 102, and a pair of branch tube sections 133*a*, 133*b*. Each section 133*a*, 133*b* is fluidly coupled to and through respective pressure pulse ports 122*a*, 122*b* to air pressure chambers 122 in each pump. A tee fitting 133*d* bifurcates the tubes into the two branch tube sections. This advantageously provides an economical arrangement which also consumes less space by permitting a single connection to be made to the crankcase upstream, and splits the air pressure pulse signals to a separate signal for each pump of the same magnitude. In other possible implementations, each pulse pump may be fluidly coupled to the engine crankcase 102 by a separate pulse tube 133.

In one design, the pulse tube 133 including sections 133*a*, 133*b*, and 133*c* are oriented and sloped downwards from each fuel pulse pump 120*a*, 120*b* back towards the pressure pulse source, such as the oil chamber inside engine crankcase 102. This allows any vaporous carryover oil entrained in the air from the engine case 102 which travels through the pulse tube 133 and enters air pressure chambers 122 inside the pumps which condenses on surfaces inside the tube or chambers to drain by gravity back to the crankcase. Concomitantly, the pulse pumps 120*a*, 120*b* are oriented if possible so that their respective pressure pulse ports 122*a*, 122*b* allow carryover liquid oil condensate within the pressure chambers to drain outwards by gravity via the pressure pulse ports through the pulse tube 133 and back to the crankcase 102. In some non-limiting implementations, the pressure pulse ports may be oriented from and including horizontal to vertically downwards if possible. It bears noting that carryover oil vapor from crankcase 102 which condenses and settles in low regions within the pulse tube 133 or pump pressure chambers may adversely affect pump performance if some drainage path back to the pressure pulse source (e.g., crankcase) is not provided to remove the oil condensate. Accumulated oil condensate can interfere with the magnitude of the positive and negative pressure signals transmitted to the diaphragms 129*a* of the pulse pumps.

Air pressure chamber 122 includes a spring-biased flexible diaphragm 129*a* movably disposed in the chamber. Spring 129*b* biases diaphragm 120*a* into the fuel expel state or position. Diaphragm 120*a* has upward/downward reciprocating stroke action to pump fuel through the pulse pump when exposed to alternating positive/negative (vacuum) pressure signals from engine crankcase 102 via pulse tube 133. The diaphragm 120*a* defines a resiliently movable and deformable roof or ceiling of the primary fuel chamber 128 and fluidly seals this chamber at top to fluidly isolate the fuel-side primary fuel chamber 128 below flexible diaphragm 129*a* from air-side air pressure chamber 122 above the diaphragm. Accordingly, as the air pressure chamber 122 is exposed to alternating positive and negative pressure signals from the engine crankcase 102, the same pressure signals are produced in the primary fuel chamber 128. Diaphragm 129*a* may be formed of any suitable material, such as elastomeric materials in some designs.

The fuel inlet 125 of upstream fuel pulse pump 120*a* is fluidly coupled to a liquid fuel source or reservoir such as fuel tank 110 by fuel inlet line or hose 131. Fuel hose 131 therefore has an inlet fluidly coupled directly to the fuel tank. Any suitable configuration of fuel inlet hose 131 may be used as dictated by the layout of the engine 101 and/or equipment to which the engine is mounted. A fuel filter 174 may be fluidly coupled to fuel inlet hose 131 between pulse pump 120*a* and the fuel tank. The liquid fuel may be gasoline in one implementation; however, other engines may use other types of liquid fuels which can pumped with the present engine fuel supply system.

The upstream fuel pulse pump 120*a* is fluidly coupled to downstream fuel pulse pump 120*b* by inter-pump fuel hose 130. One end of fuel hose 130 is coupled to fuel outlet 126 of upstream pulse pump 120*a* and the other end is coupled to fuel inlet 125 of downstream pulse pump 120*b*. Any suitable configured of inter-pump fuel hose 130 may be used as needed.

Figure 2:
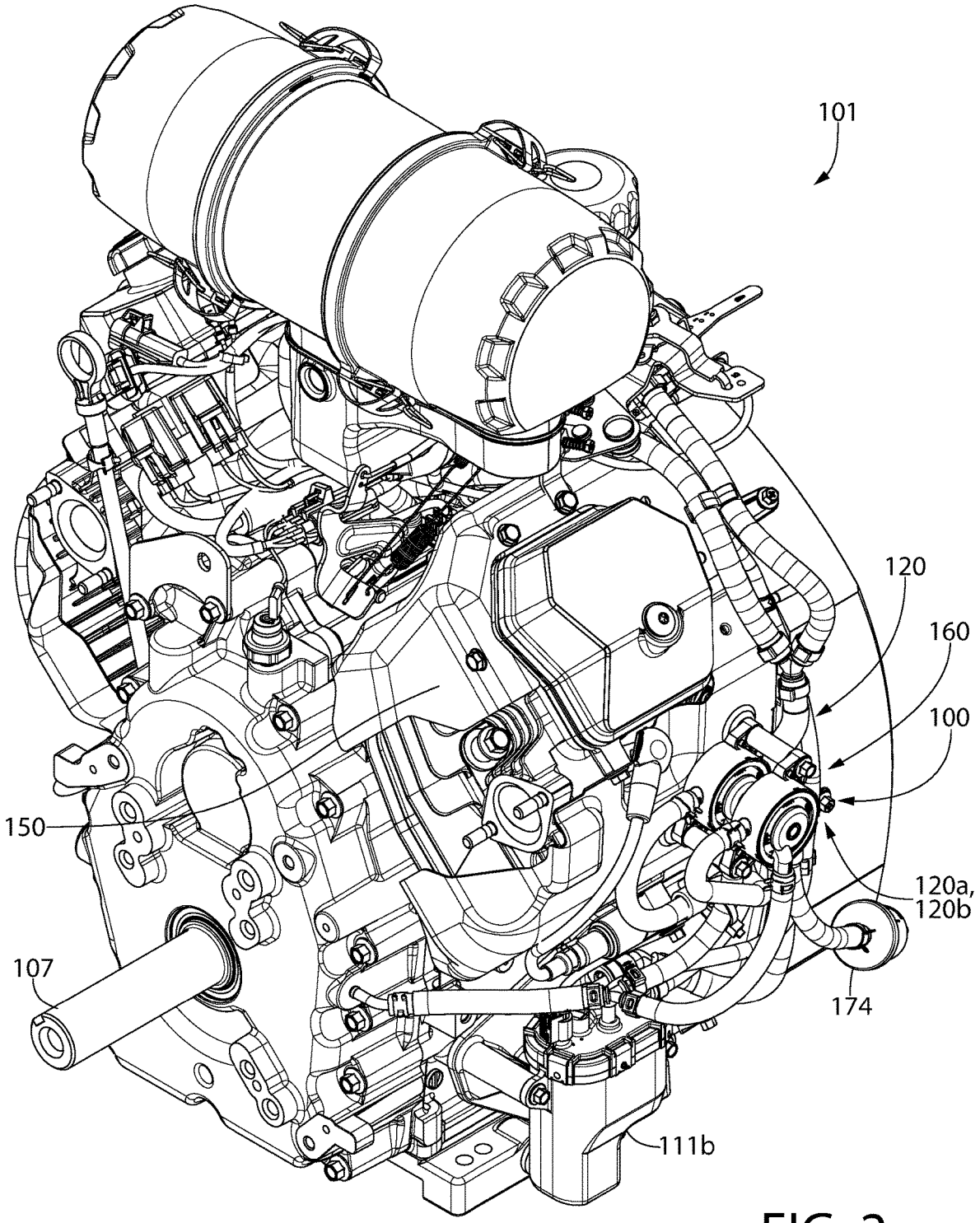
FIG. 2 is a perspective view of a first implementation of an internal combustion engine including the fuel supply system with the dual fuel pumps of FIG. 1, the pumps being mounted to an engine appurtenance in a stacked relationship.
Figure 3:
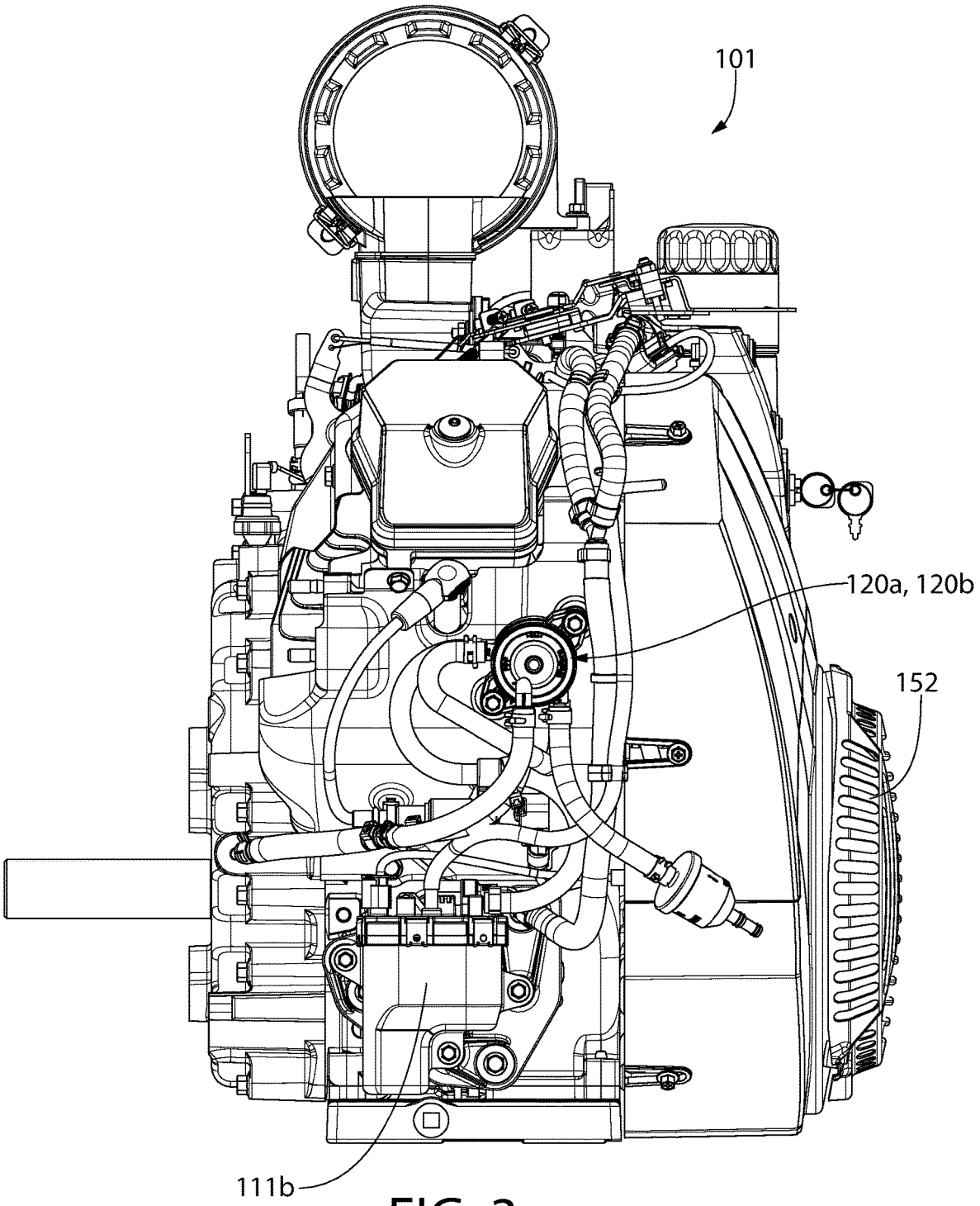
FIG. 3 is a first side view thereof.
Figure 4:
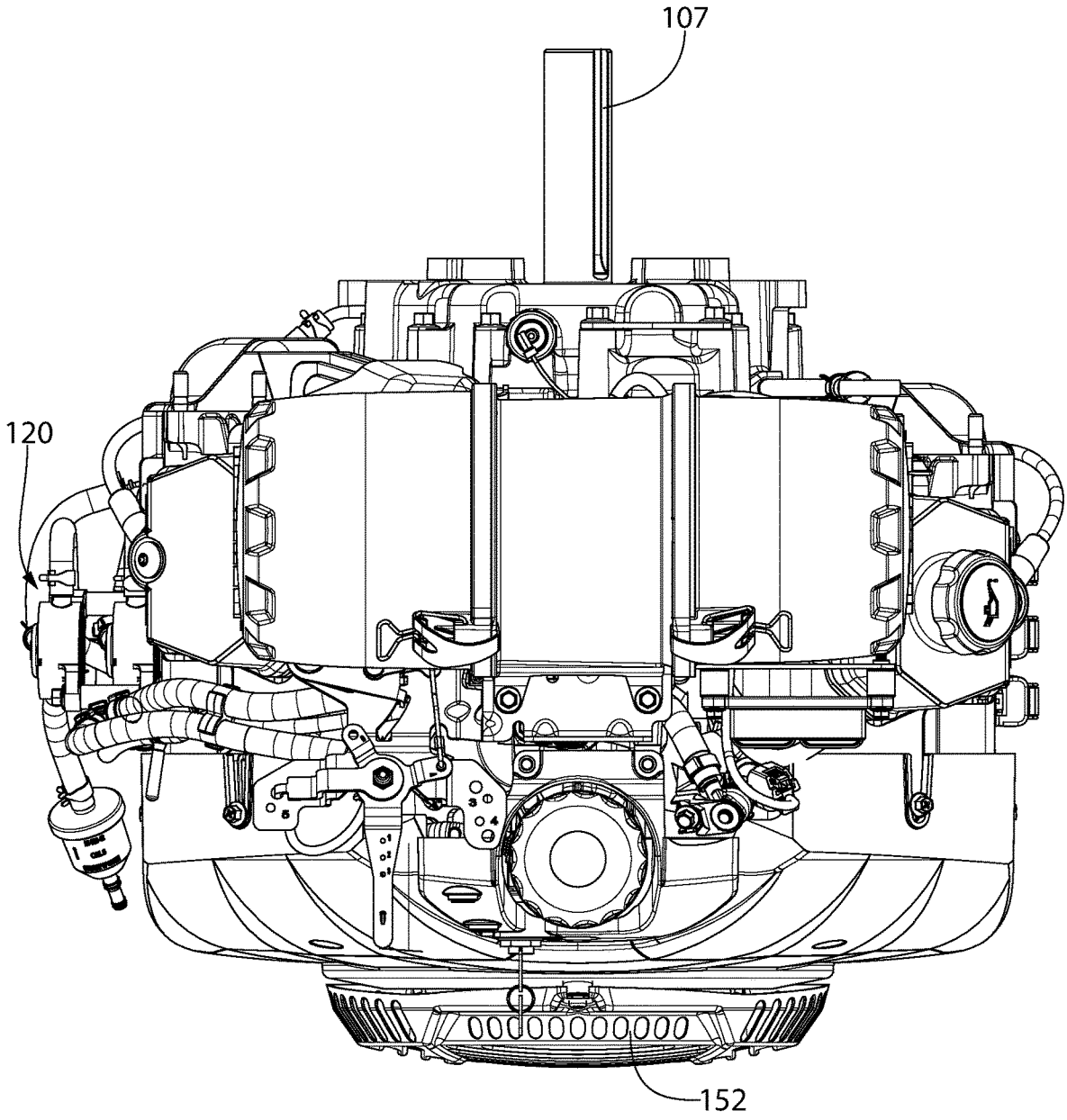
FIG. 4 is a top view thereof.
Figure 5:
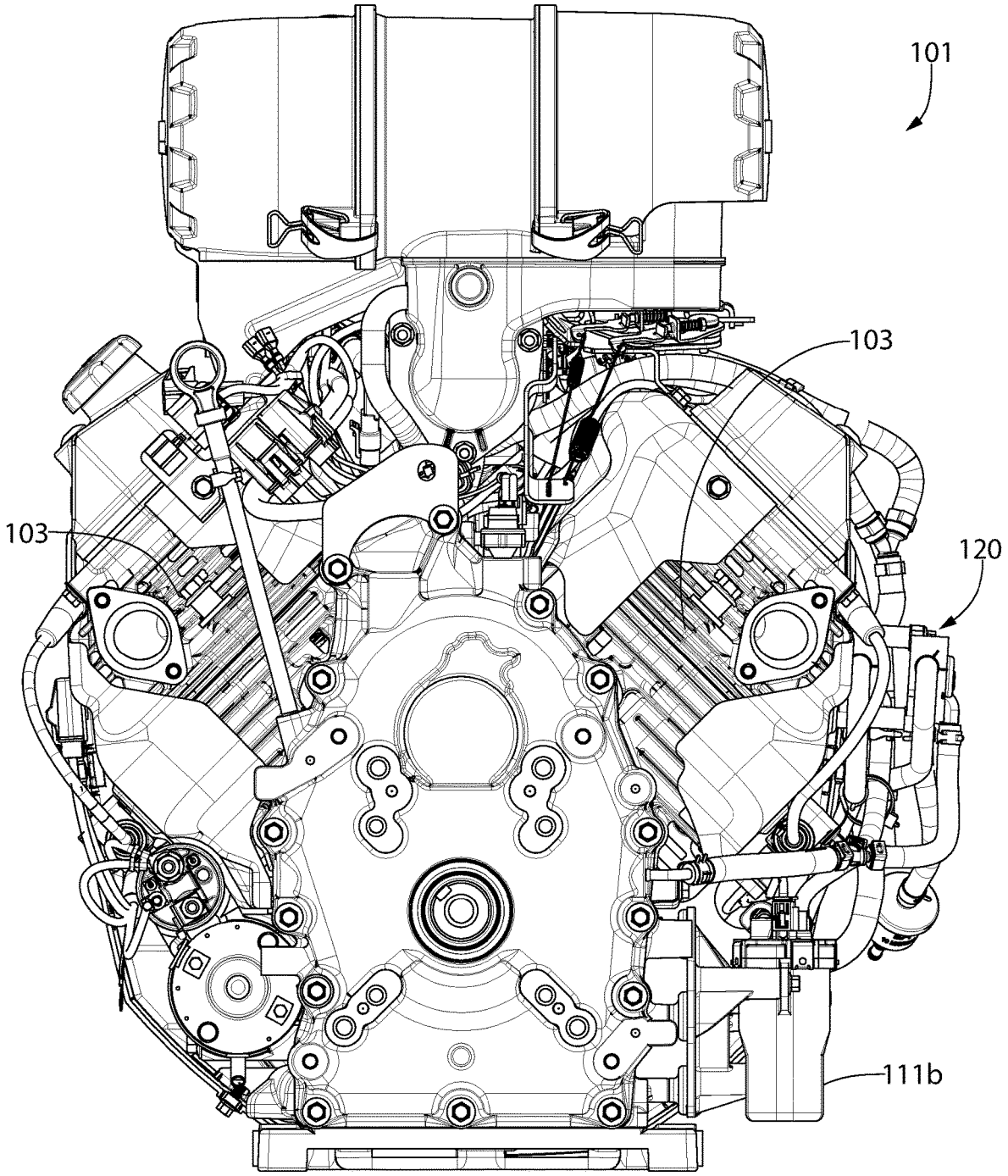
FIG. 5 is a second side view thereof.
Figure 6:
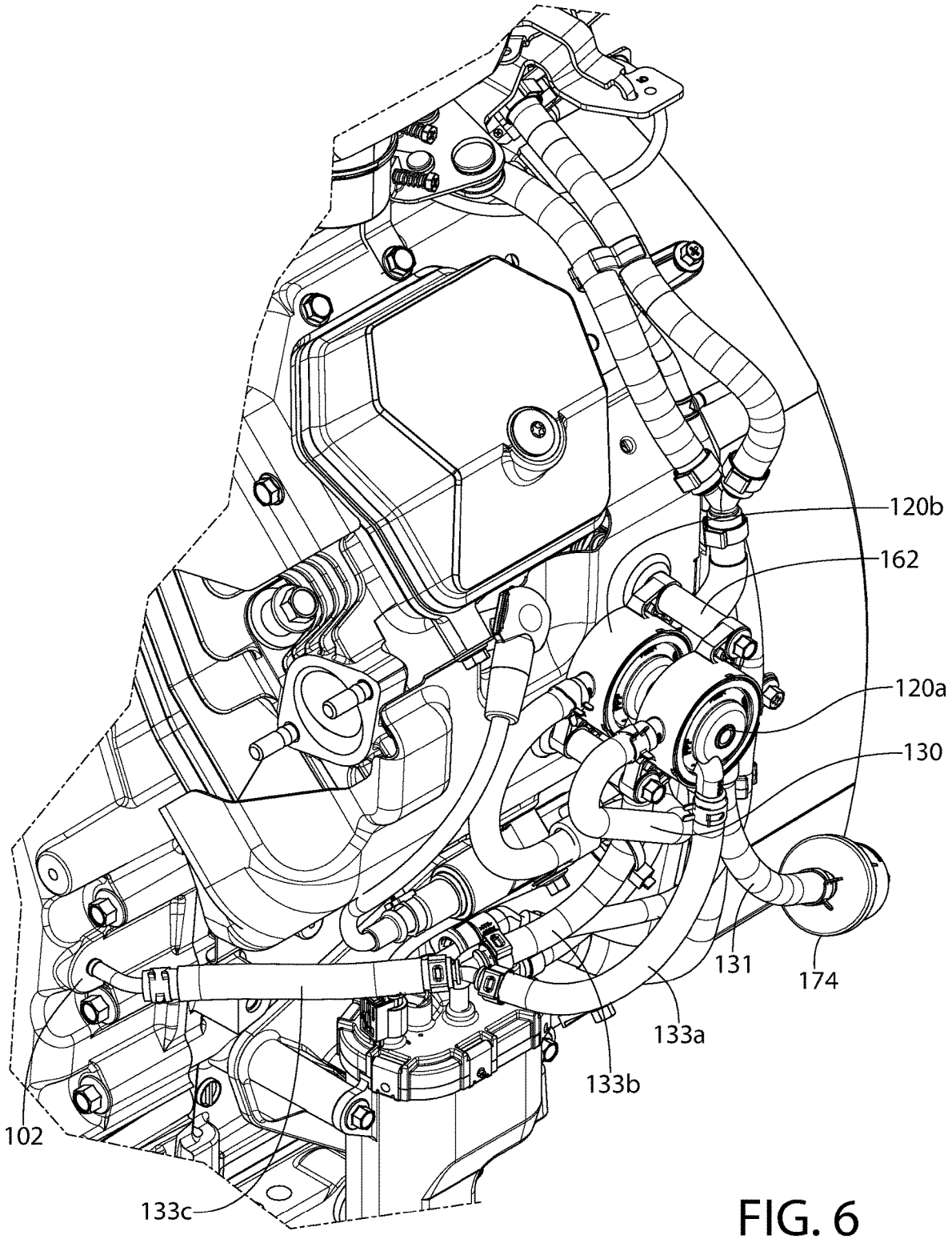
FIG. 6 is an enlarged detailed taken from FIG. 1.
Figure 7:
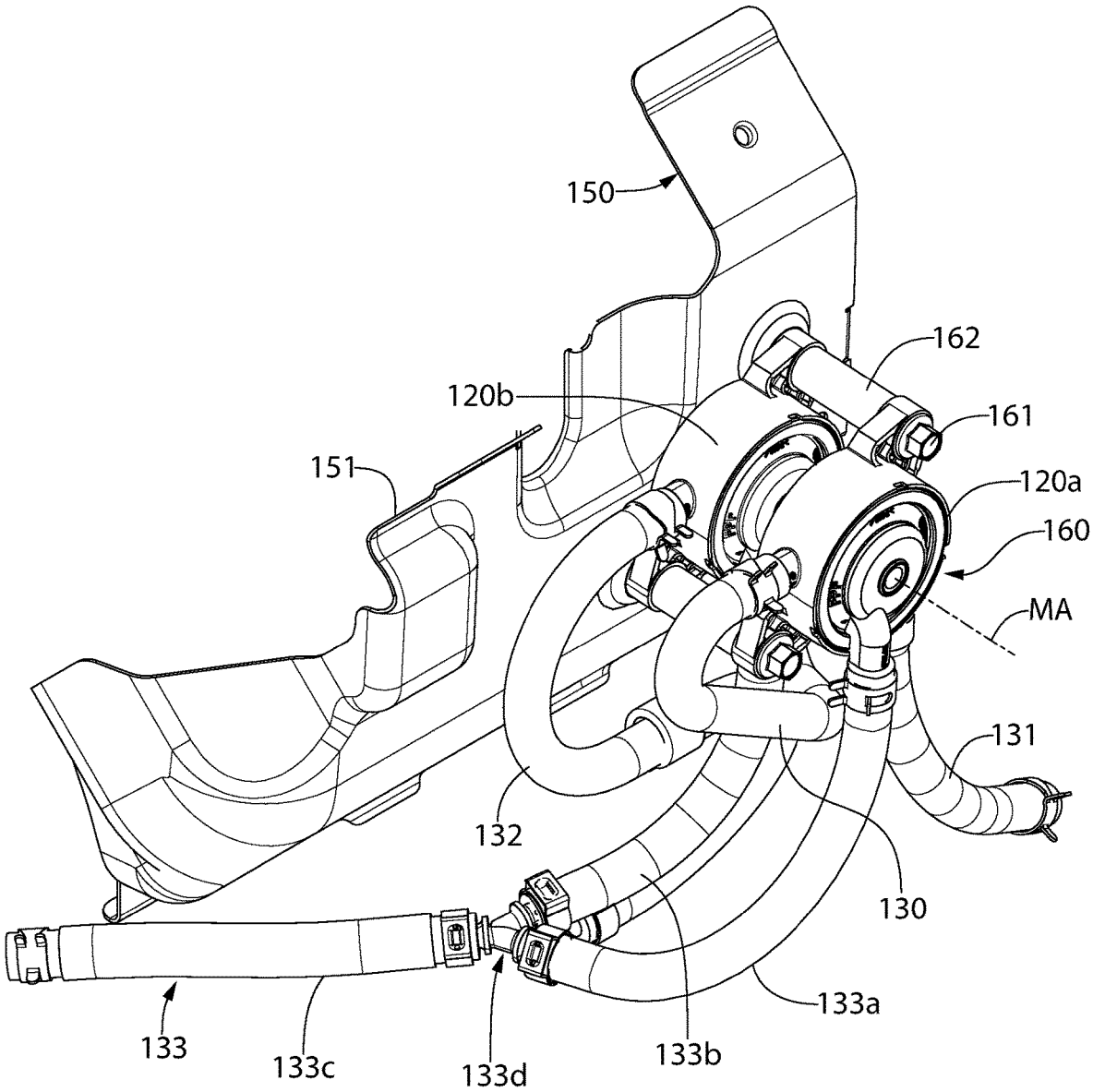
FIG. 7 is first perspective view of the fuel pumps and engine appurtenance of FIG. 2 in isolation from the engine.
Figure 8:
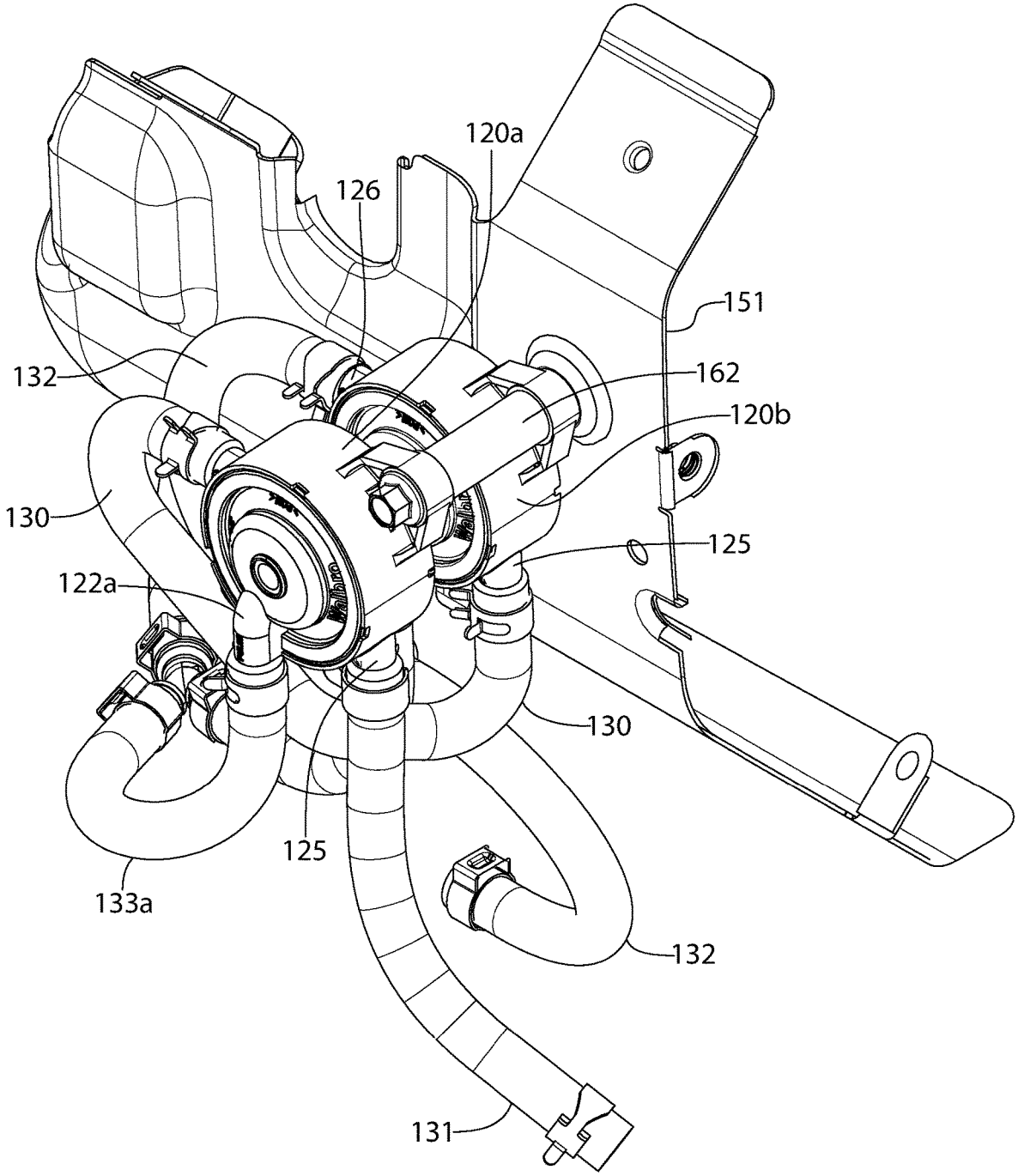
FIG. 8 is a second perf thereof.
Figure 9:
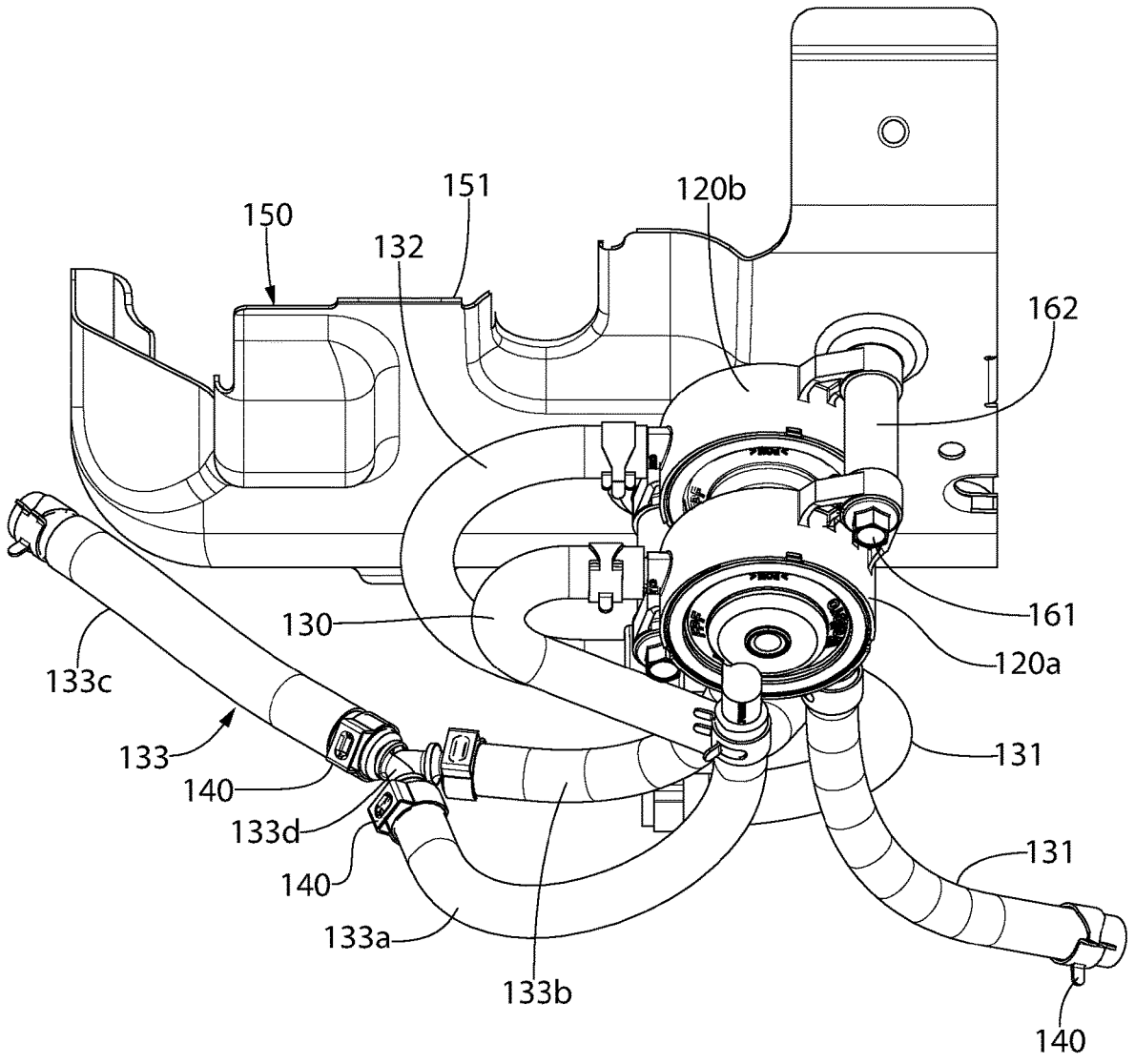
FIG. 9 is a top perspective view thereof.
Figure 10:
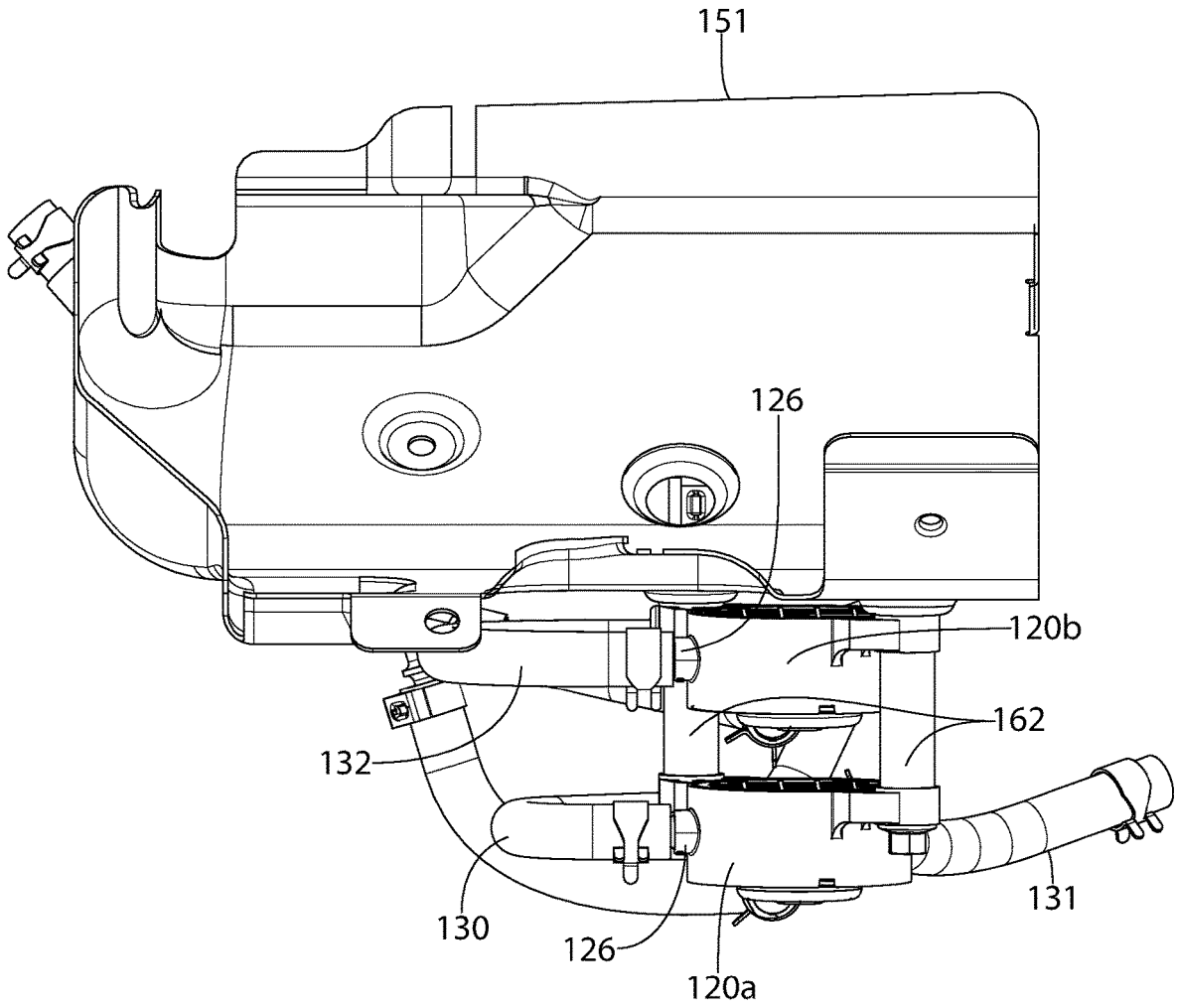
FIG. 10 is a top view thereof.
Figure 11:
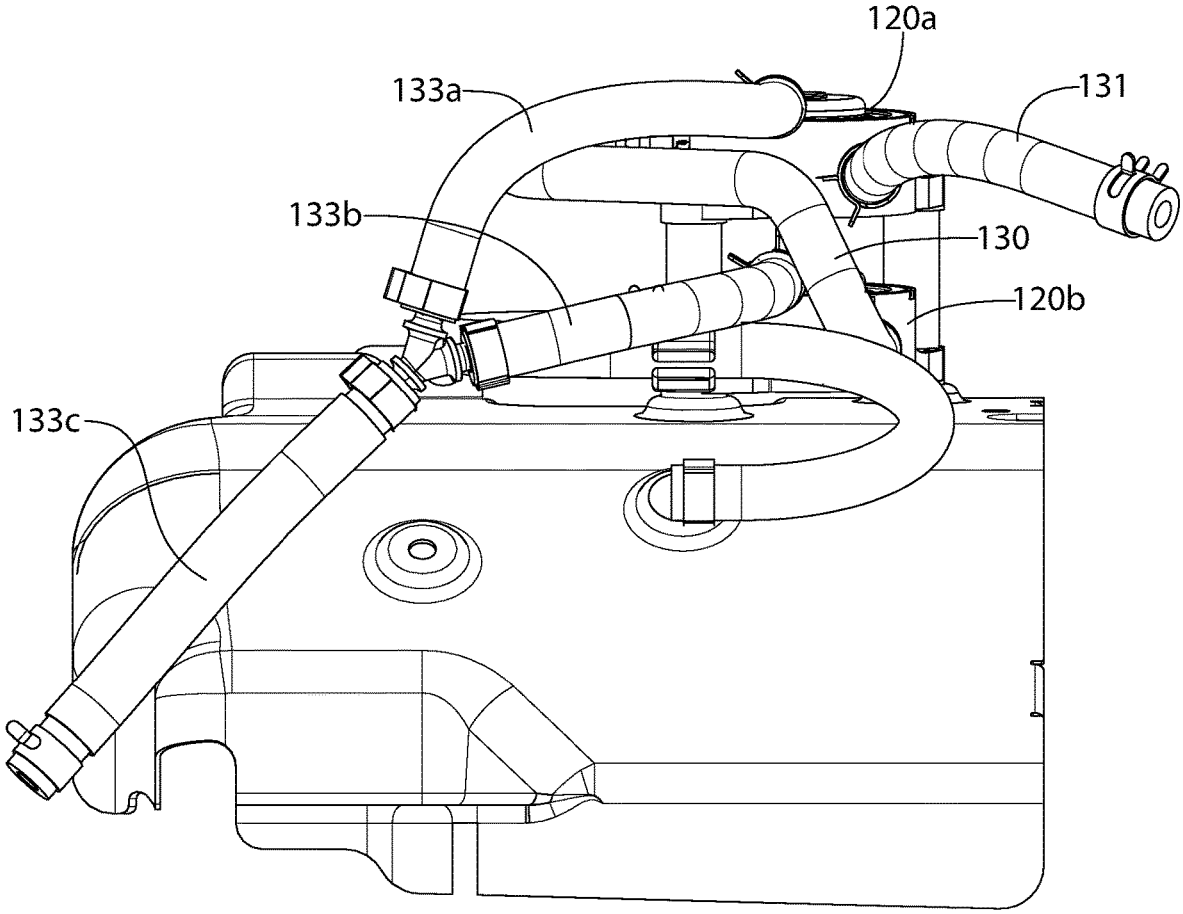
FIG. 11 is a bottom view thereof.
Figure 12:
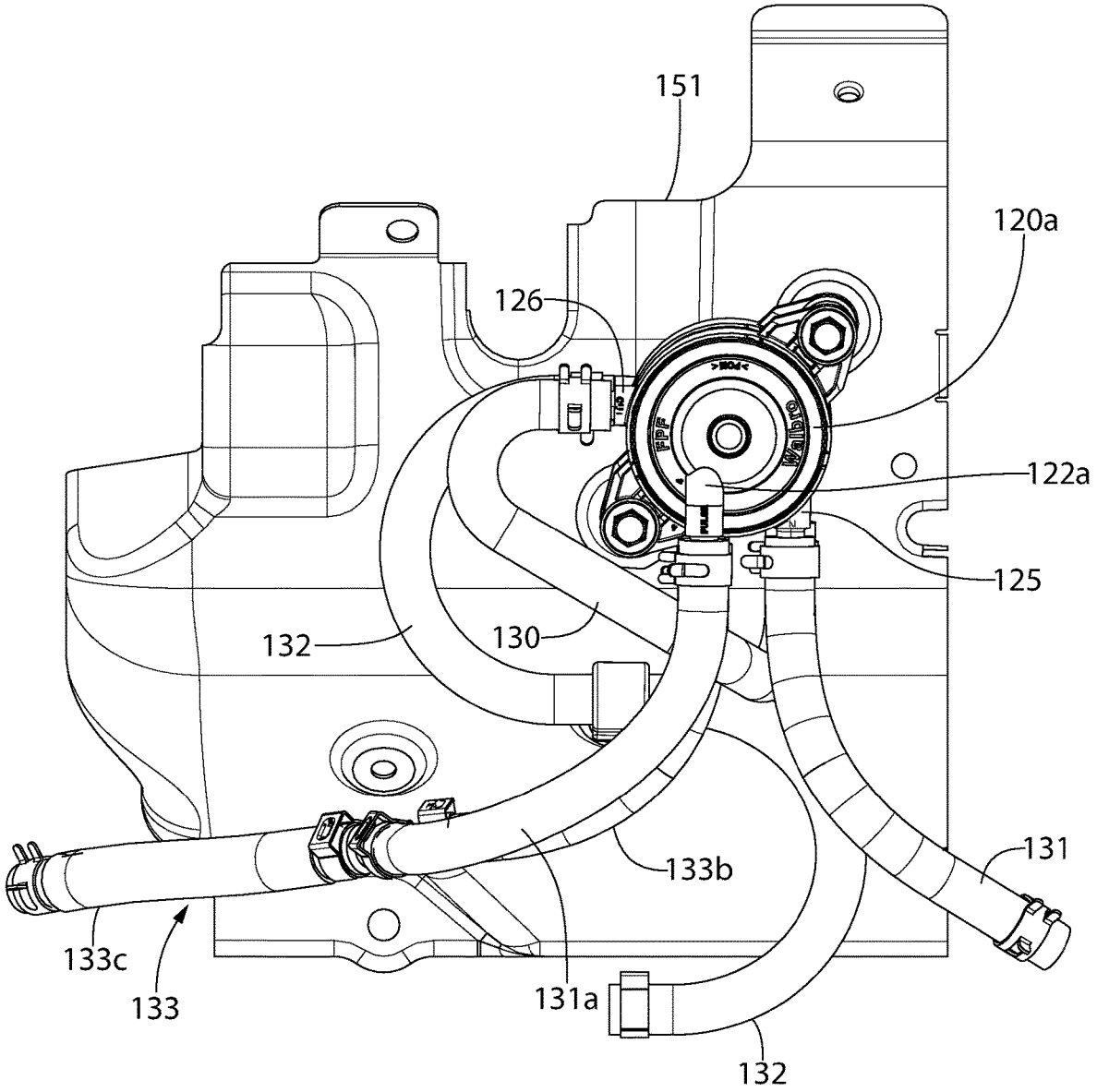
FIG. 12 is a side view thereof.
Figure 13:
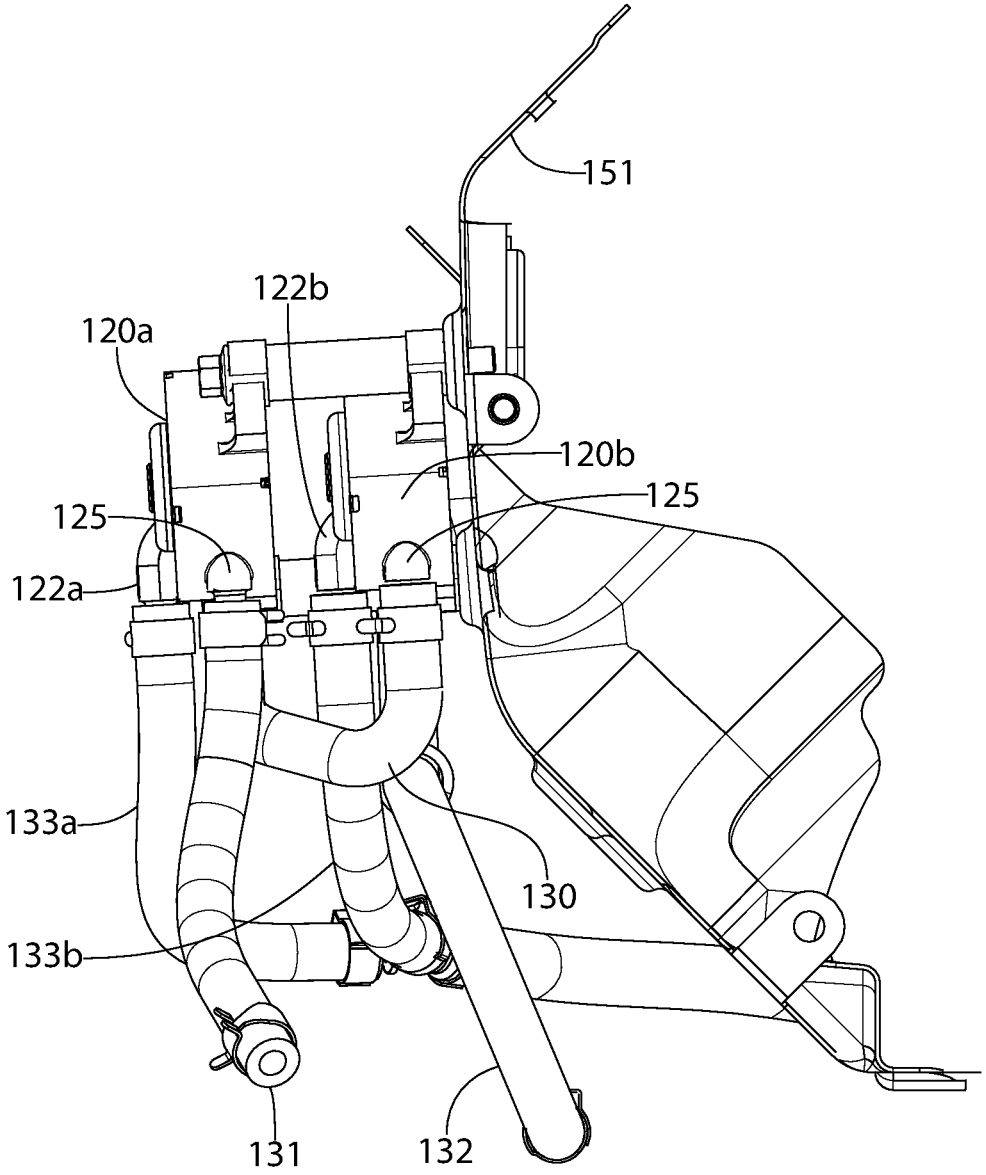
FIG. 13 is a first end view thereof.
Figure 14:
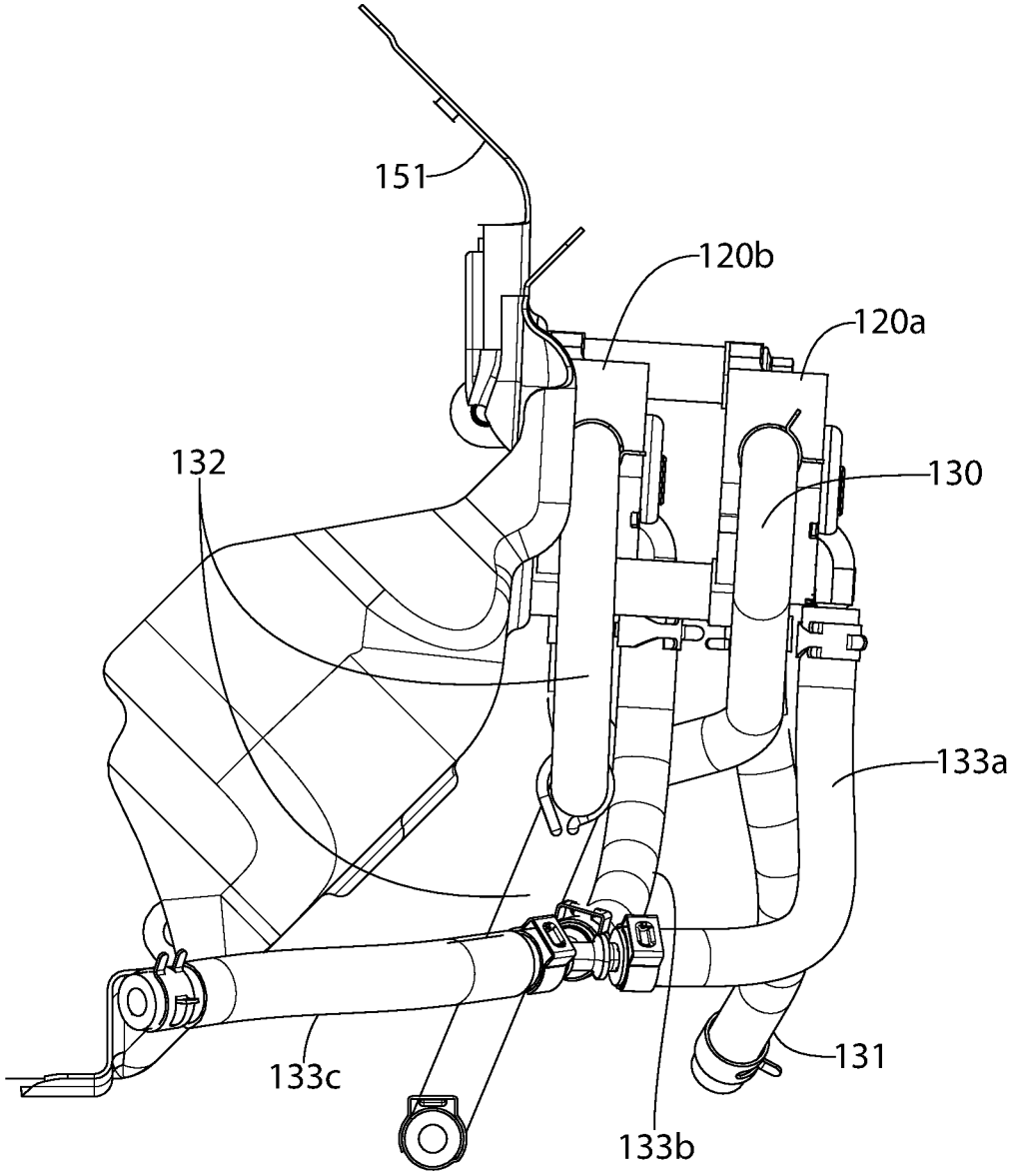
FIG. 14 is a second end view thereof.
Figure 15:
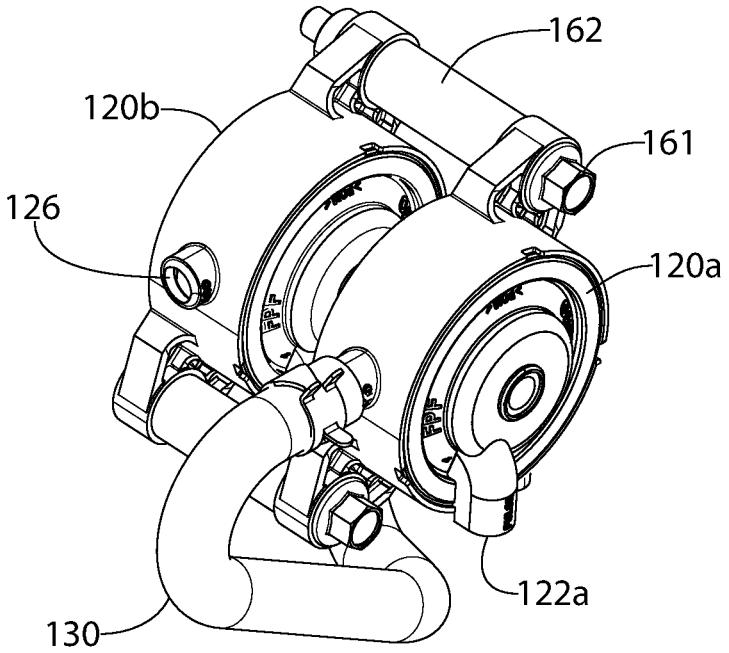
FIG. 15 is a first perspective view of the stacked fuel pumps in isolation and showing the inter-pump fuel connection.
Figure 16:
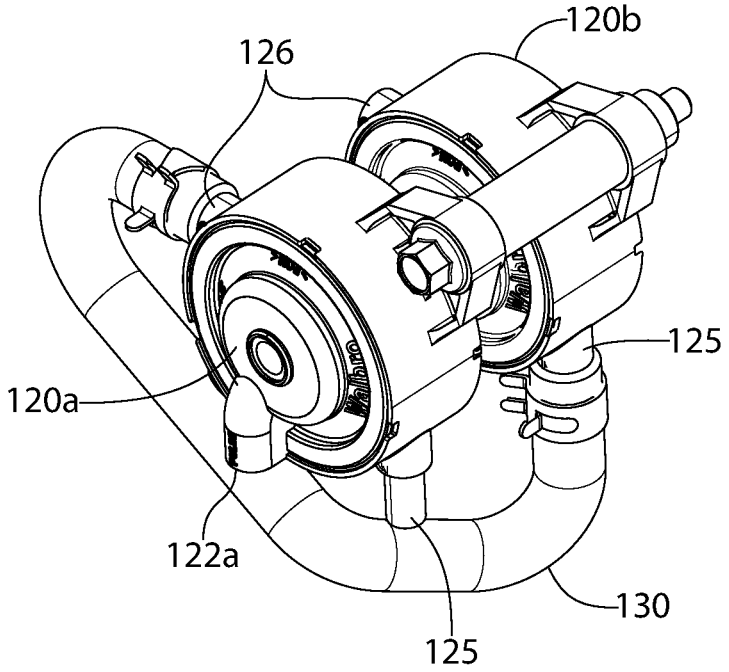
FIG. 16 is a second perspective view thereof.
Figure 17:
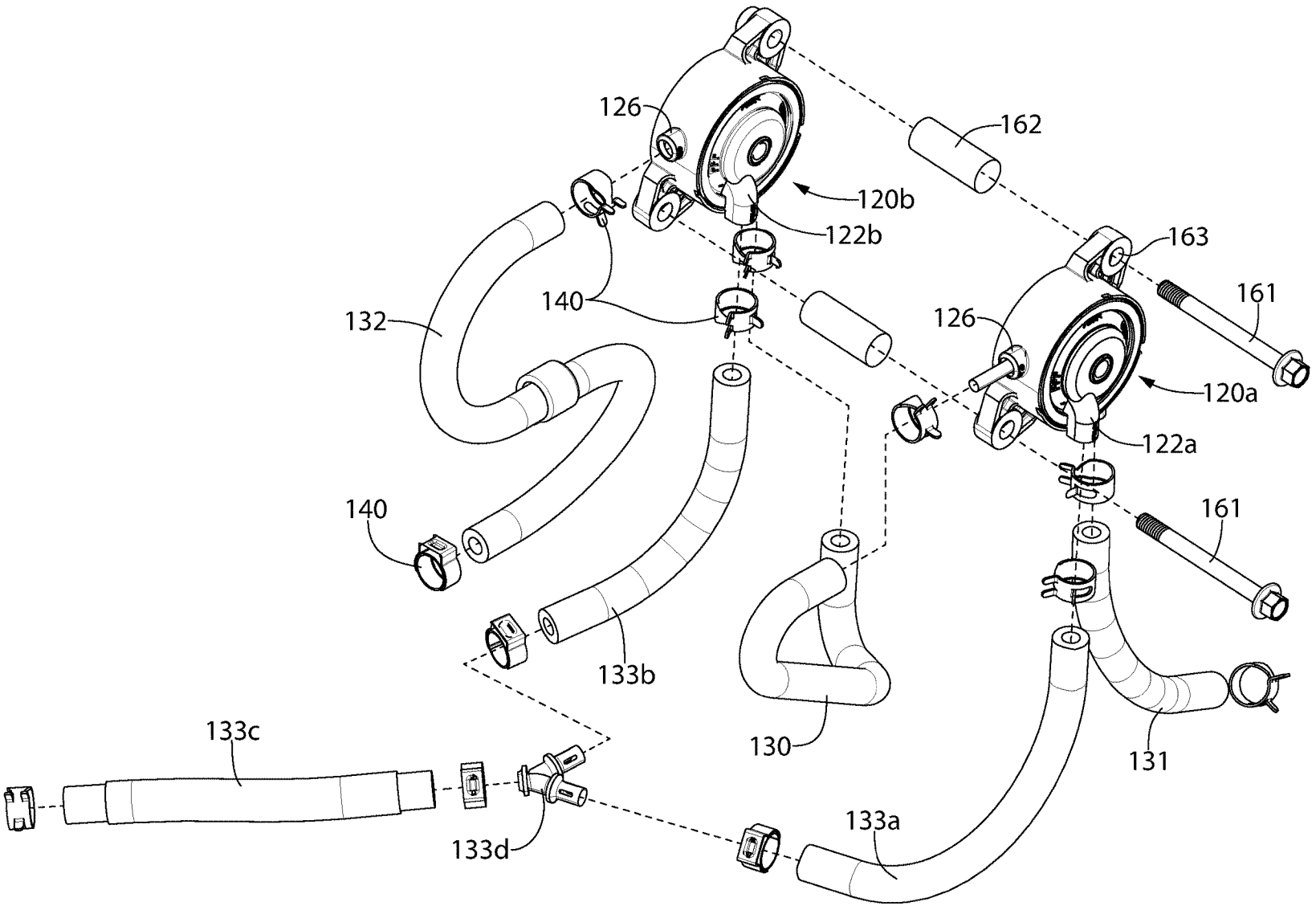
FIG. 17 is an exploded perspective view of the stacked fuel pumps with fuel hoses and air pressure pulse tubes, fluid couplings, and pump mounting accessories.
Figure 22:
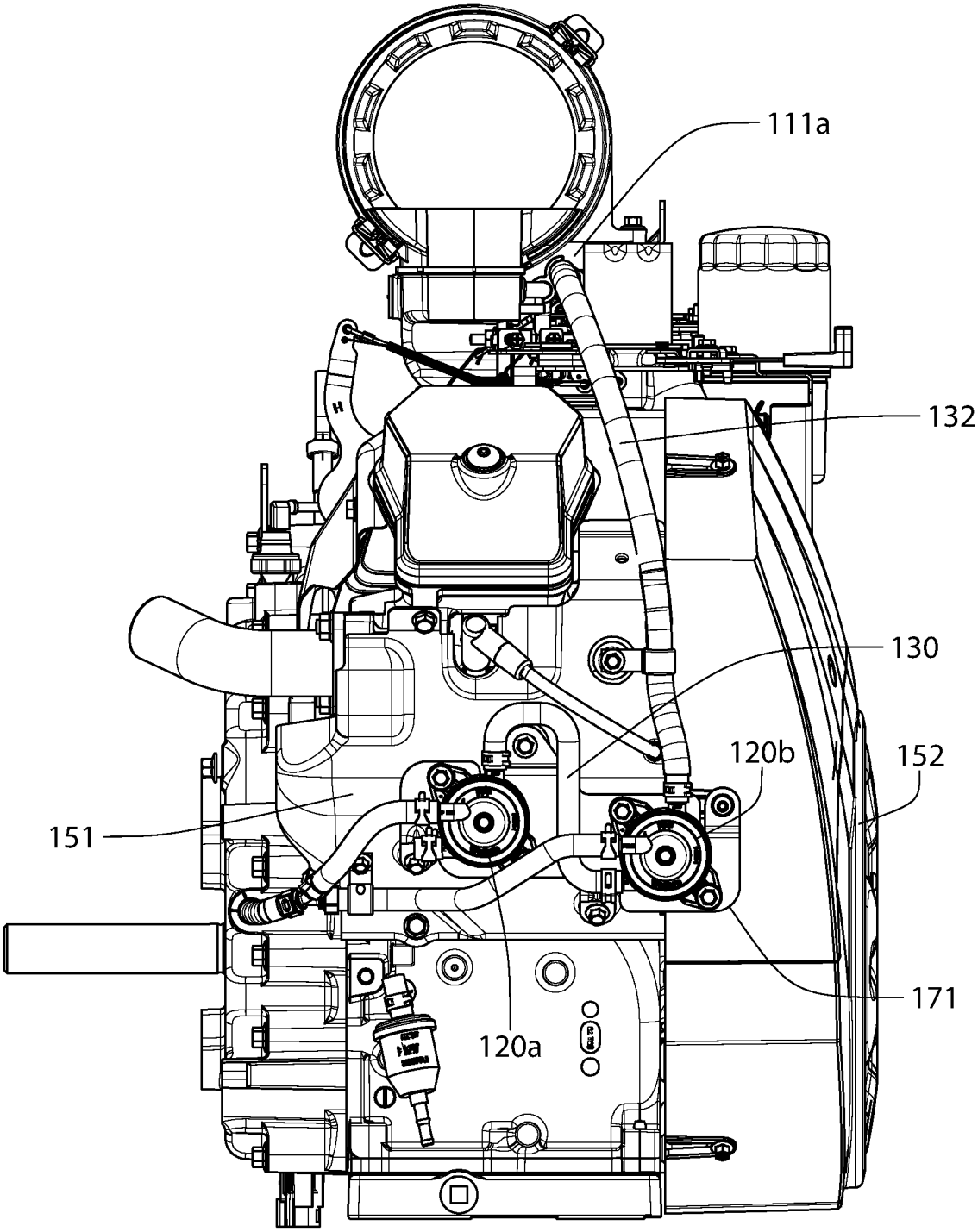
FIG. 22 is a side view of the engine and fuel supply system of FIG. 20.
Figure 23:
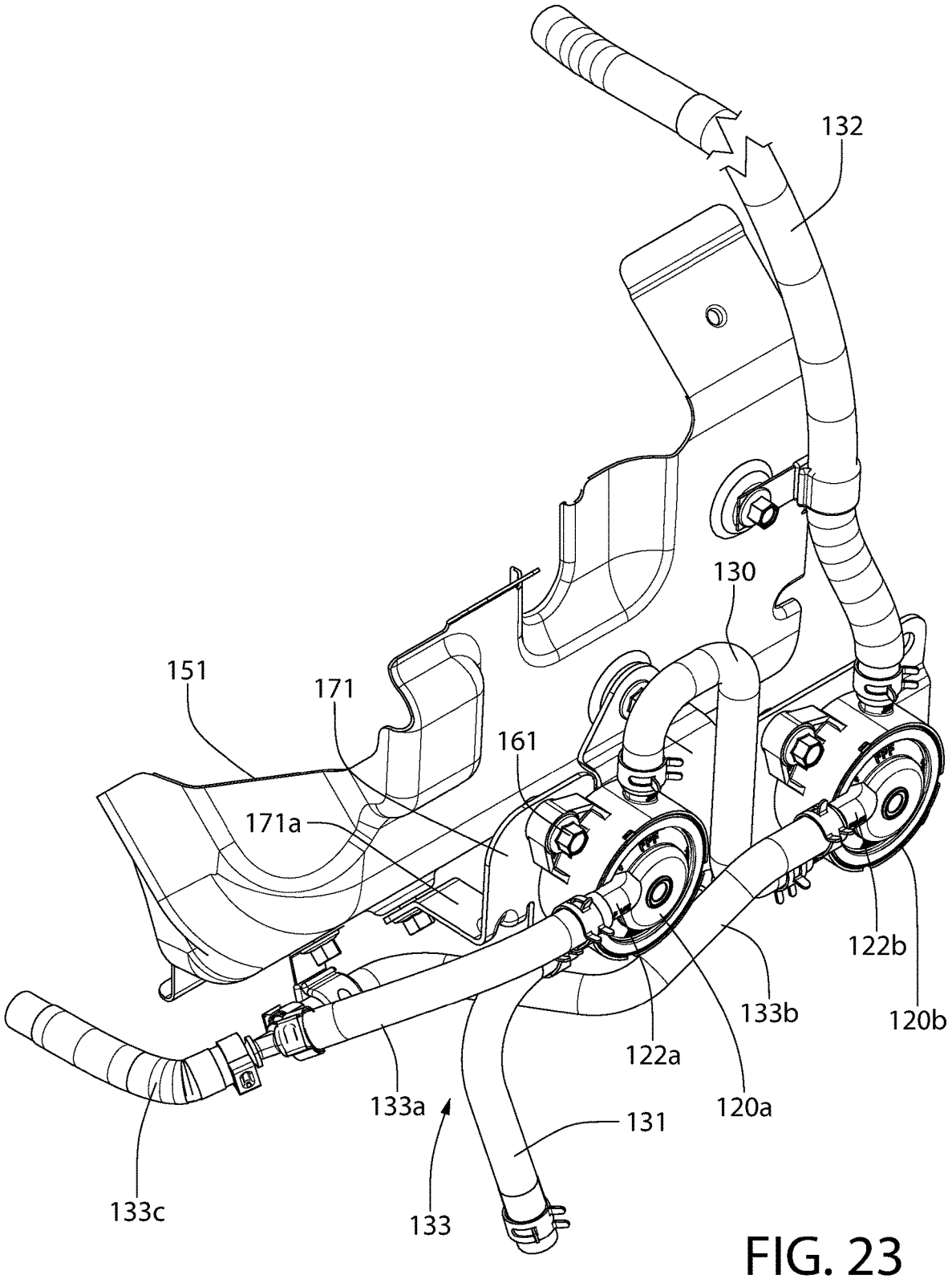
FIG. 23 is first perspective view of the fuel pumps and engine appurtenance of FIG. 20 in isolation from the engine.

The fuel outlet 126 from downstream fuel pulse pump 120*b* is fluidly coupled to a fuel metering device 111 associated with engine via fuel discharge hose 132 as shown. The fuel discharge hose 132 therefore has an outlet fluidly coupled directly to the fuel metering device 111. The fuel metering device 111 in turn discharges the fuel to the fuel inlets 106*a* of engine 101. In some implementations, fuel metering device 111 may be a carburetor 111*a* (see, e.g., FIG. 22) or a fuel injection pump 111*b* (see, e.g., FIG. 2) of an electronic fuel injection system. Both carburetors and fuel injection pumps are known in the art and require no further explanation here. Any suitable configuration of fuel discharge hose 132 may be used as needed.

Figure 24:
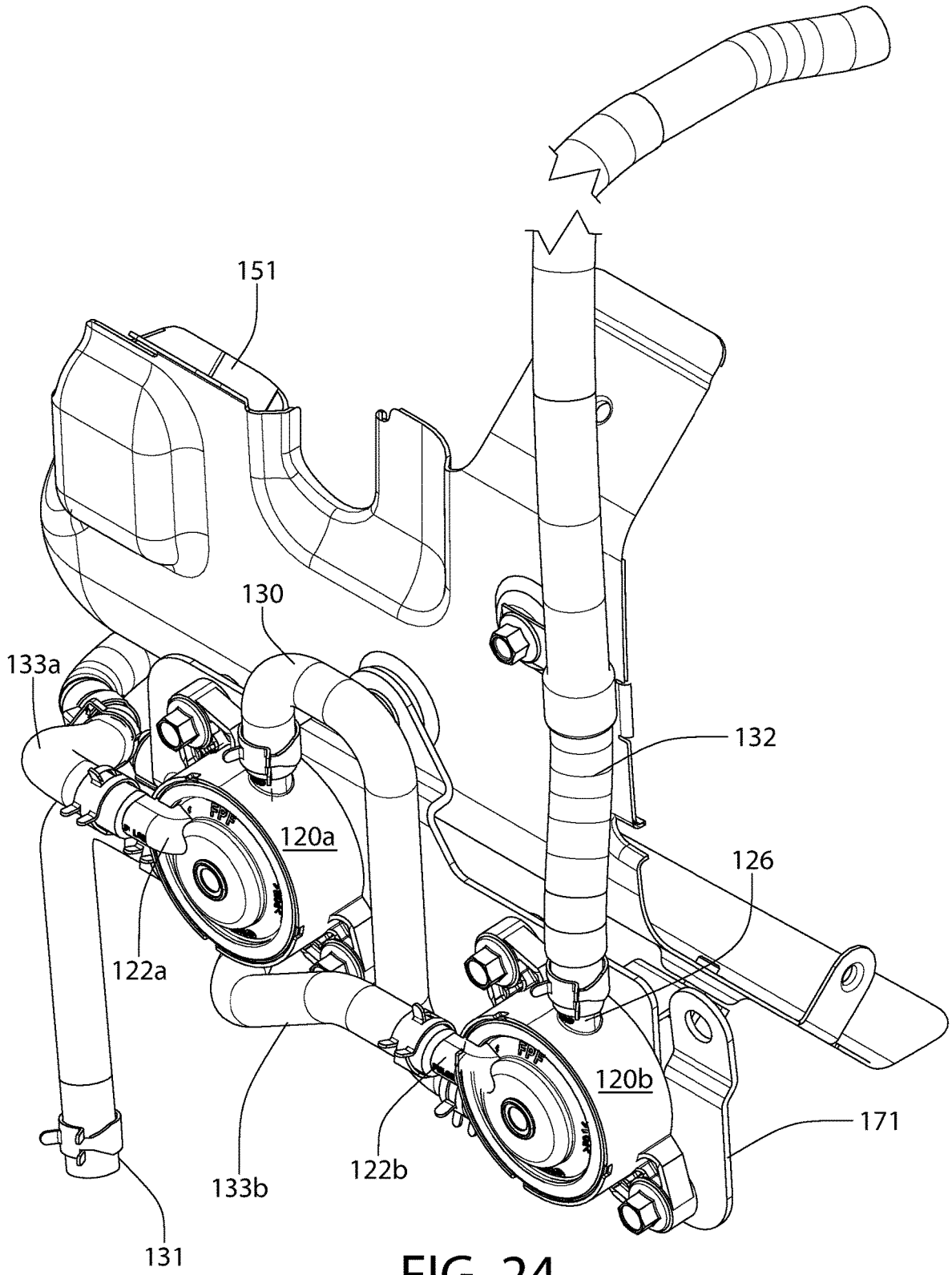
FIG. 24 is a second perf thereof.
Figure 25:
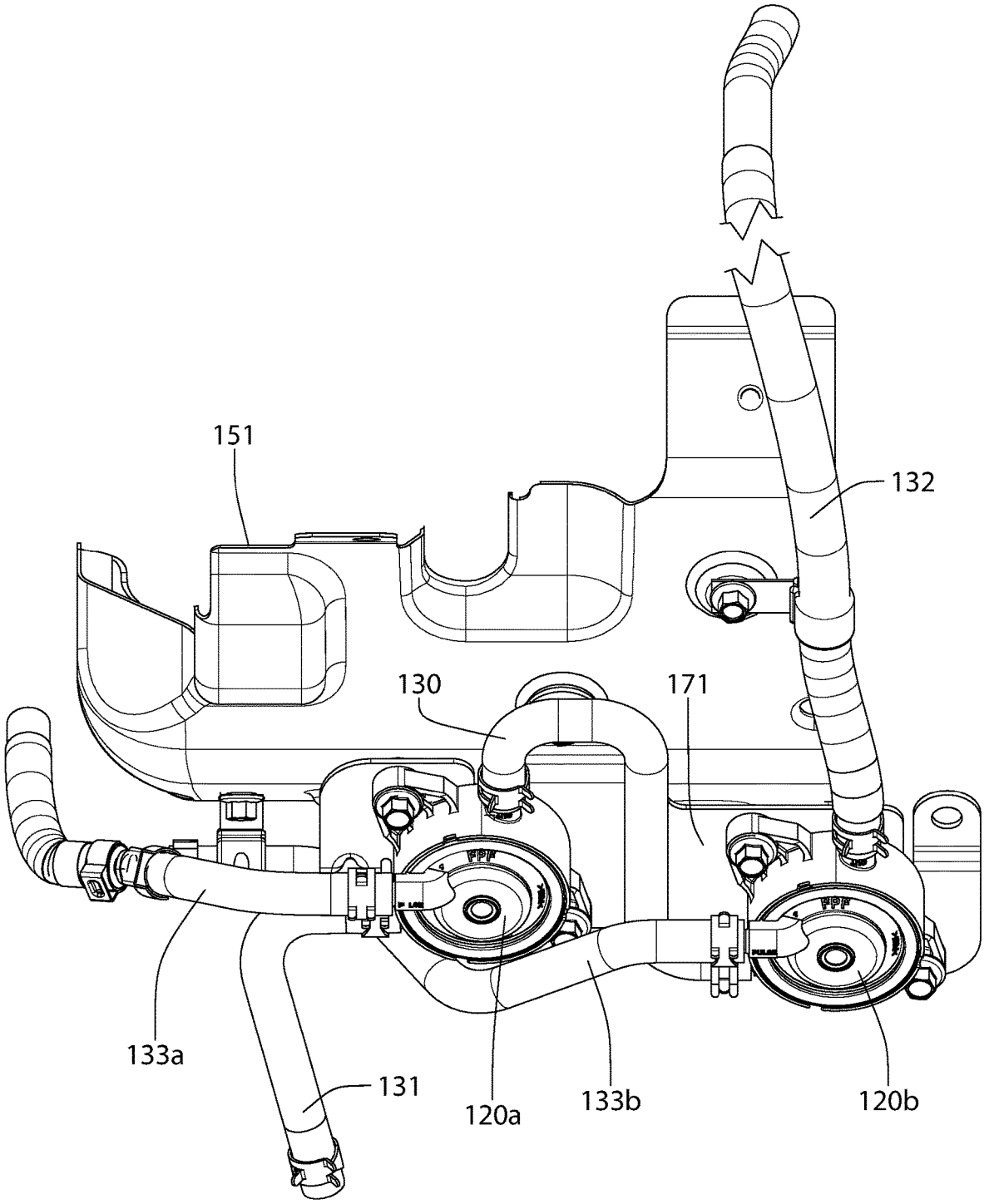
FIG. 25 is a top perspective view thereof.
Figure 26:
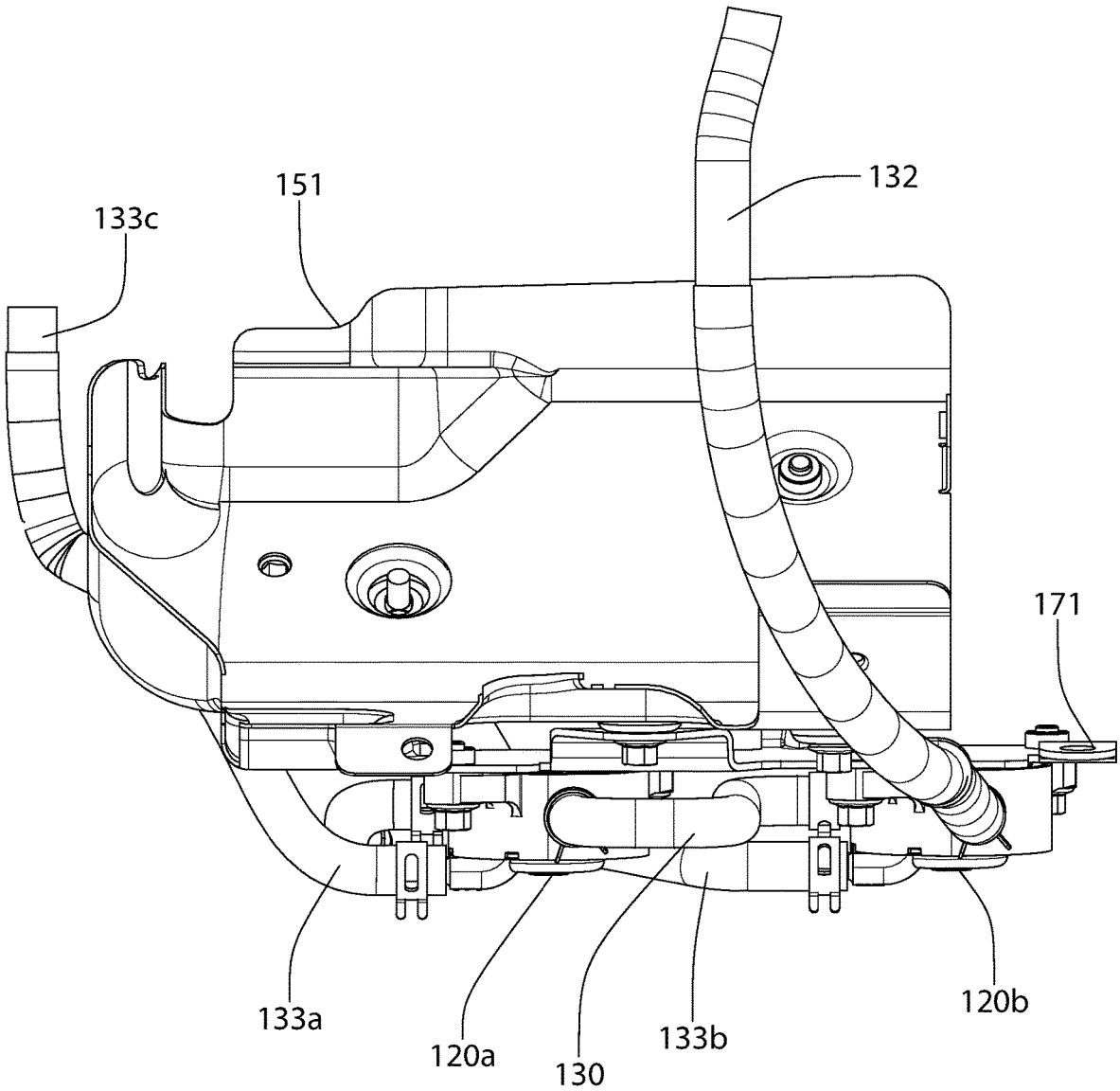
FIG. 26 is a top view thereof.
Figure 32:
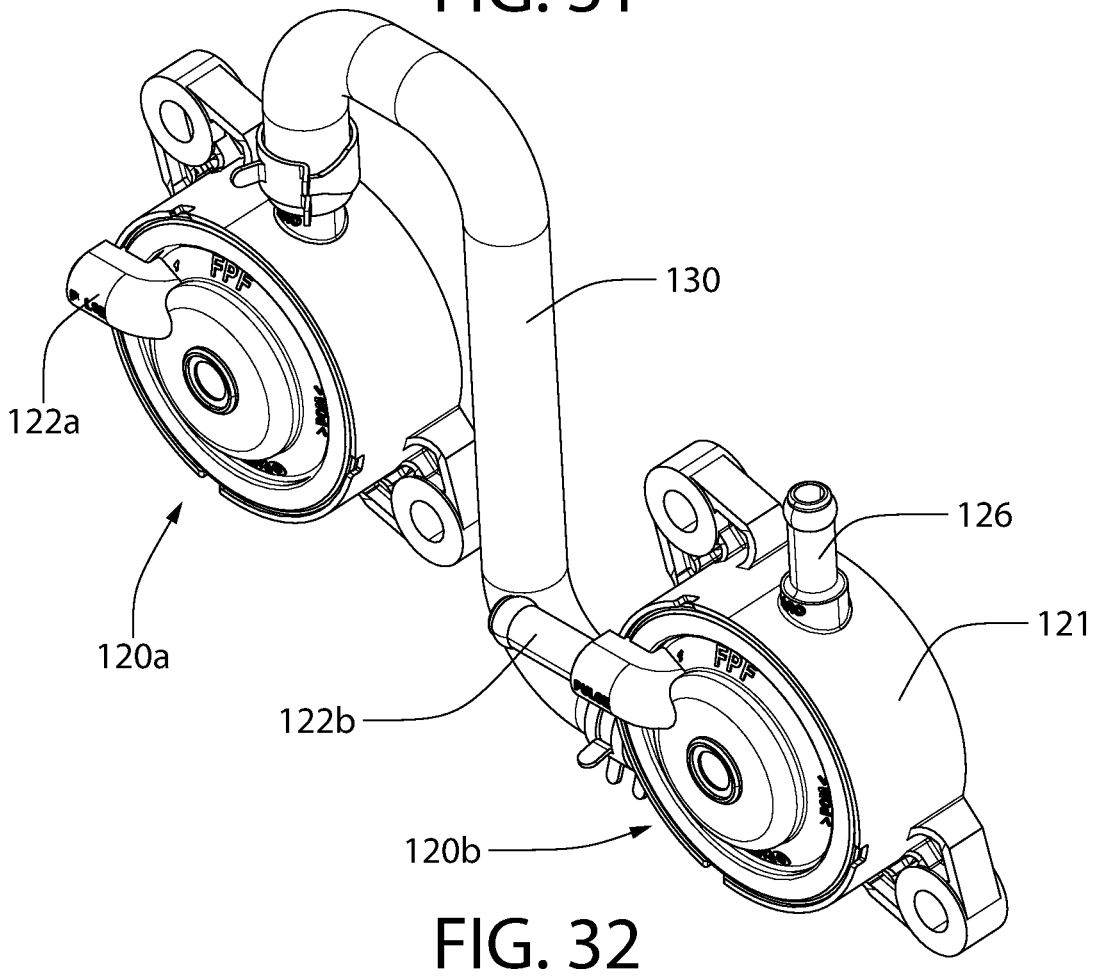
FIG. 32 is a second perspective view thereof.
Figure 33:
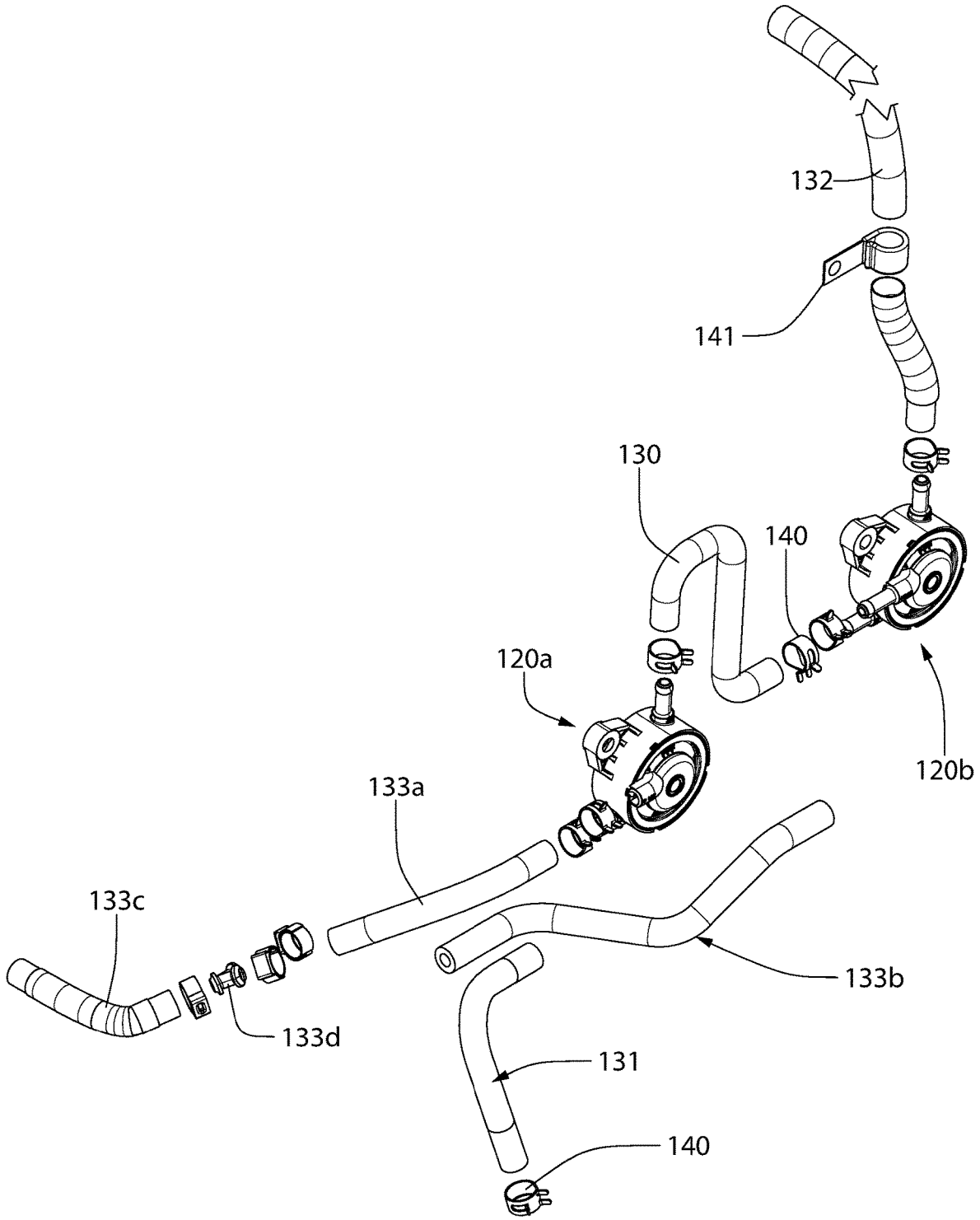
FIG. 33 is an exploded perspective view of the stacked fuel pumps with fuel hoses and air pressure pulse tubes, fluid couplings, and pump mounting accessories.

Various suitable fluid couplings 140 such as tube/hose clamps or other couplings may be used to couple the pulse tubes and fuel hoses to the pulse pumps 120*a*, 120*b*, fuel tank 110, and fuel metering device 111. Such couplings are commercially-available and the type used does not limit the fuel supply system disclosed herein. Tube or hose clamps 141 (see, e.g., FIGS. 24 and 32) may be provided to secure certain portions of the pulse tubes 133 and fuel hoses 130-132 to the engine or engine appurtenance as needed for support.

A primary fuel supply path between fuel tank 110 and fuel metering device 111 is collectively defined in order by fuel inlet hose 131, fuel pulse pump 120*a*, inter-pump fuel hose 130, fuel pulse pump 120*b*, and fuel discharge hose 132. This is the one-way flow circuit through which fuel is supplied to the engine from the fuel tank.

In operation, a method or process for pumping fuel using pulse pumps 120*a*, 120*b* arranged in a serial flow fuel path in one non-limiting example may comprise first creating a negative pressure within the engine crankcase 102 via operation of the pistons 104. The negative pressure signal is transmitted via pulse tube 133 to each air pressure chamber 122 of the pumps simultaneously. This deforms and draws the diaphragms 129*a* in the upward stroked and direction against the downward bias action of diaphragm spring 129*b*, thereby concomitantly creating a negative pressure inside primary fuel chambers 128 of the pumps at the same time. The upstream pulse pump 120*a* draws fuel inwards from the fuel reservoir or source (e.g., fuel tank 110) into inlet fuel chamber 123 and primary fuel chamber 128, while the downstream pulse pump 120*b* concurrently draws fuel inwards via inter-pump fuel hose 130 from the upstream pump (e.g., outlet fuel chamber 124 and primary fuel chamber 128) into the inlet and primary fuel chambers of the downstream pulse pump. The outlet check valve 127*b* which remains seated due to negative pressure above in primary fuel chamber 128 prevents fuel from flowing back into primary fuel chamber 128 from outlet fuel chamber 124 of downstream pulse pump 120*b* during the upward stroke of the diaphragm 129*a*.

A positive pressure signal is next generated inside crankcase 102 as the pistons reverse direction during operation of the engine. This positive pressure signal is transmitted to air pressure chambers 122 simultaneously via pulse tube 133. This deforms and pushes the diaphragms 129*a* in an opposite downward stroke and direction in conjunction with the downward bias action of diaphragm spring 129*b*, thereby concomitantly creating a positive pressure inside primary fuel chambers 128 of the pumps at the same time. The upstream pulse pump 120*a* expels and transfers fuel from its primary fuel chamber 128 into outlet fuel chamber 124 and outwards via inter-pump fuel hose 130 into the inlet fuel chamber 123 of downstream pulse pump 120*b*, (e.g., outlet fuel chamber 124 and primary fuel chamber 128) with a positive pressure to enhance the ability of the downstream pulse pump to operate at a higher mean pressure and fuel dispensing volume. The inlet check valve 127*a* which remains seated due to positive pressure above in primary fuel chamber 128 prevents fuel from entering the primary fuel chamber from the inlet fuel chamber during the downward stroke of the diaphragm 129*a*.

The fuel discharged by the downstream pulse pump 120*b* flows through fuel discharge hose 132 to the fuel metering device 111 previously described herein and then to the engine 101. The above fuel pumping cycle repeats with each upward and downward stroke of the pump diaphragms 129*a* as the pistons reciprocate upwards and downwards in the engine cylinders 103*a* while the engine is in operation.

Although the fuel pulse pumps 120*a*, 120*b* may be arranged in a series fuel path, different mounting options and arrangements may be provided which may be appropriate for different engine and engine appurtenance configurations based on spatial constraints and engine equipment layouts.

FIGS. 2-17 depict a stacked mounting arrangement 160 usable for pulse pumps 120*a*, 120*b*. The pulse pumps are arranged in stacked relationship along a common mounting axis MA. For convenience of description and purposes of the present discussion, the mounting axis MA is defined as passing through the centerline CL of both pumps and through both the air pressure chamber 122 and primary fuel chamber 128 (see, e.g., FIG. 1). Centerline CL passes through the geometric center of each pump and is oriented generally parallel to the pump sides. In the stacked mounting arrangement, the centerlines CL of the pumps are coaxially aligned with each other and the mounting axis MA.

Pumps 120*a*, 120*b* are physically coupled together by mounting fasteners 161. Fasteners 161 may be threaded fasteners such as bolts or screws; however, other suitable fastening means may be used. Fasteners 161 may be received through mounting apertures 163 of the pumps. The fasteners have sufficient length to both detachably couple each pump together and to mount the stacked pump assembly 120 as a single unit to a suitable engine support surface 150 in a fixed and stable manner. Any suitable available engine support surface that may provide a convenient mounting location may be used. As examples, without limitation, an engine support surface 150 may be part of the engine body (e.g., crankcase 102, cylinder block 103, etc.) or engine appurtenance (e.g., airflow baffle, shroud, heat shield, etc.) supported directly or indirectly from the engine body which can provide a suitable rigid support surface for the pump assembly. In the non-limiting illustrated example, support surface 150 may be defined by a cylinder block baffle 151 which is mounted to the cylinder block in spaced relation by separate mounting members. Such a pump mounting provides an air space between the baffle and cylinder block 103 through which cooling air generated by a blower 152 is directed to cool the cylinder block. The baffle 151 advantageously shields the pump assembly from heat generated by the cylinder block when the engine is operating such that the pulse pumps 120*a*, 120*b* are not directly exposed to high engine temperatures which enhances pump longevity and notably reduces thermal effects on pumping performance.

Pulse pumps 120*a*, 120*b* of the stacked pump assembly 120 may be closely coupled but in spaced apart relationship to each other by use of tubular spacers 162. Spacers 162 are configured to receive mounting fasteners 161 completely therethrough. The spacers provide clearance for manually making the fuel hose and pulse tube fluid connections previously described herein to each pump. Accordingly, although the fuel pulse pumps may be physically coupled together, the pump housings do not contact each other in this non-limiting example. In other possible stacked pump arrangements, the pump housing may contact each other. When the mounting fasteners and spacers are assembled, the pumps are rigidly coupled in stacked relationship to the cy block baffle 151.

As variously shown in FIGS. 1-16, some or all of the fuel hoses 130, 131, 132 and/or the pulse tube 130 (including sections 133*a*-133*c*) may be semi-rigid pre-formed hoses in structure. Use of such semi-rigid hoses and tubes allows the engine designers to select the optimum routing for each of these flow conduits depending on the layout of the engine and associated engine appurtenances. The same hose and tube routings may therefore advantageously be duplicated after initial manufacturing in the event the end user needs to replace any of these flow conduits.

Figure 27:
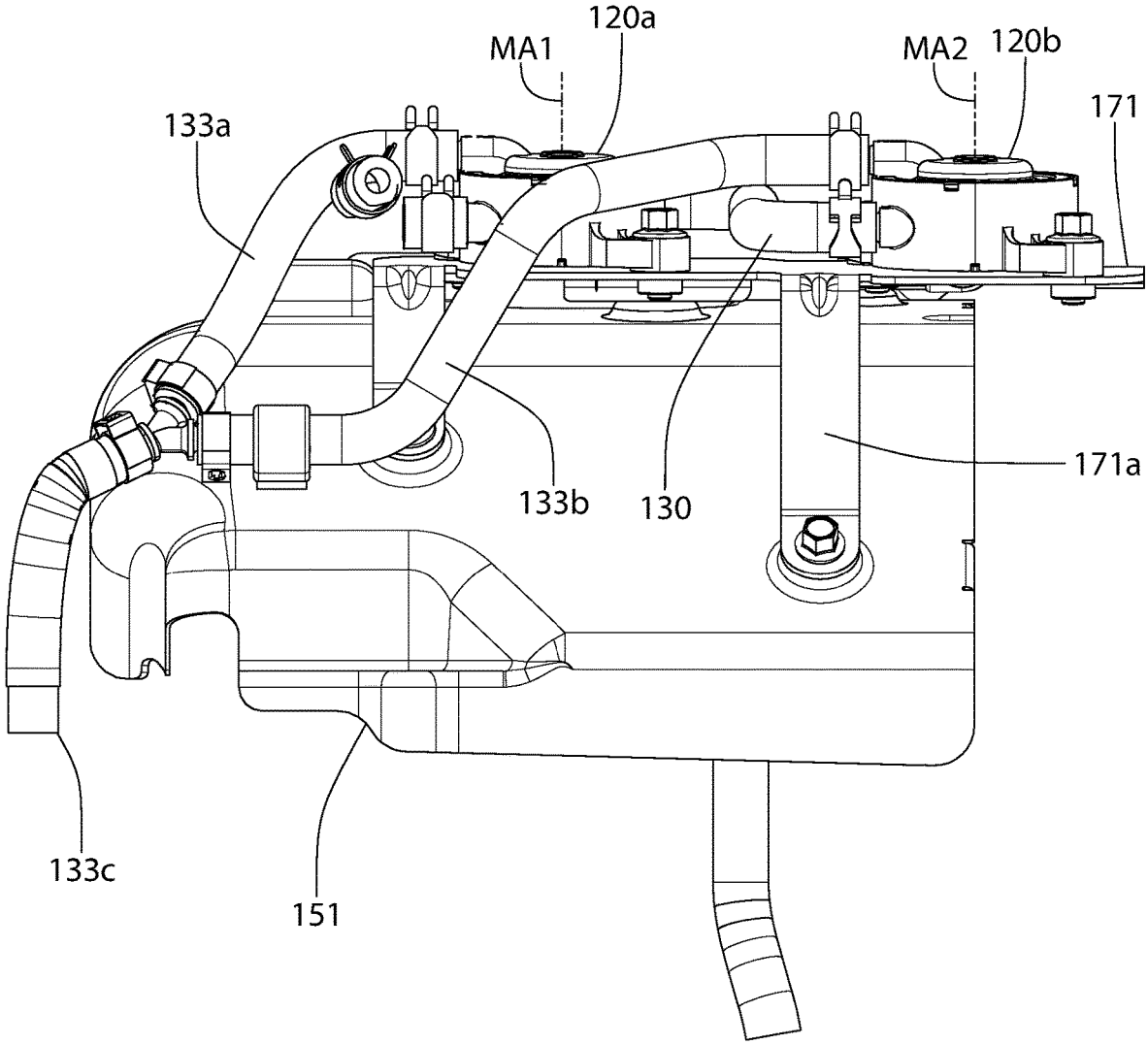
FIG. 27 is a bottom view thereof.
Figure 28:
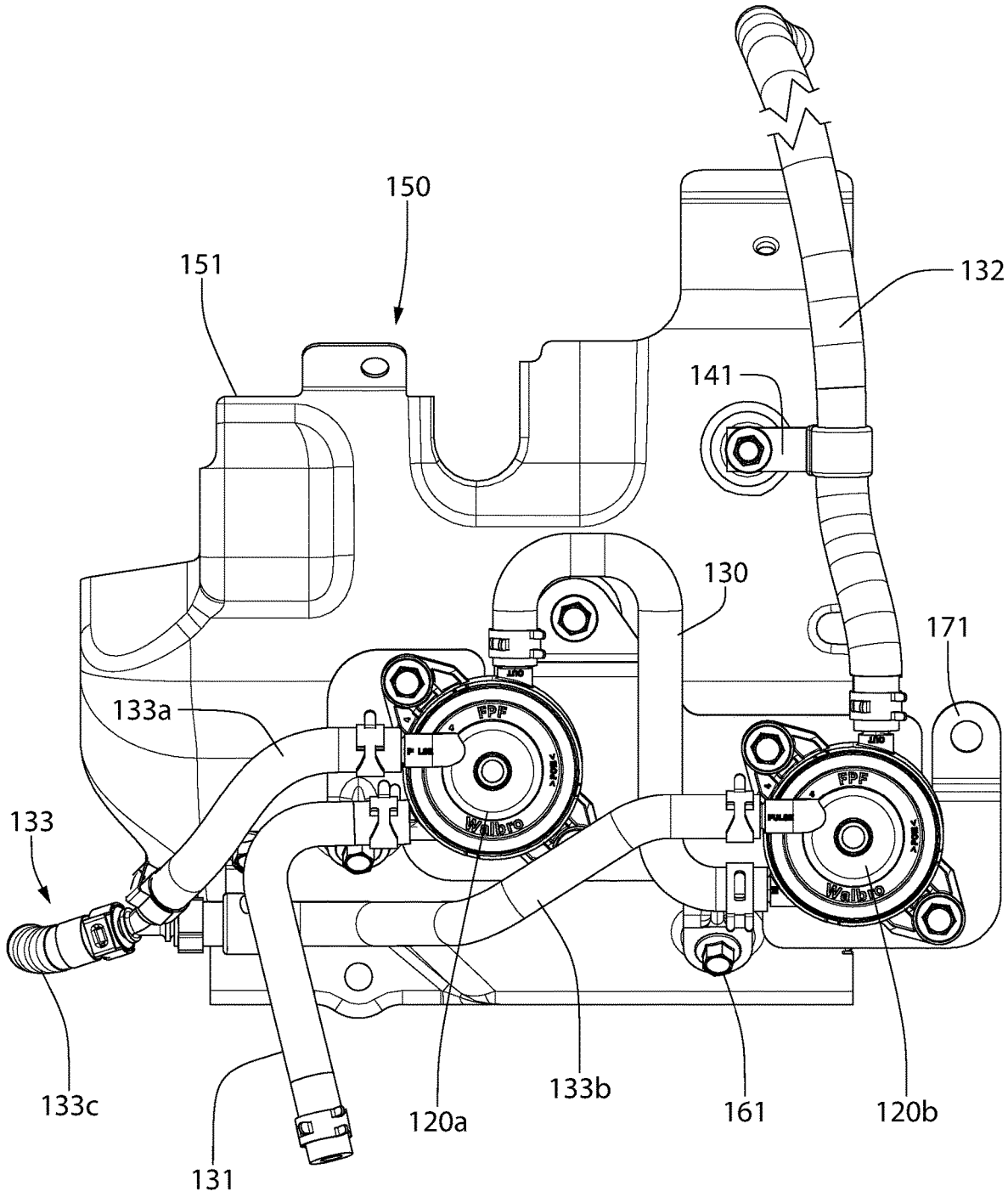
FIG. 28 is a side view thereof.
Figure 29:
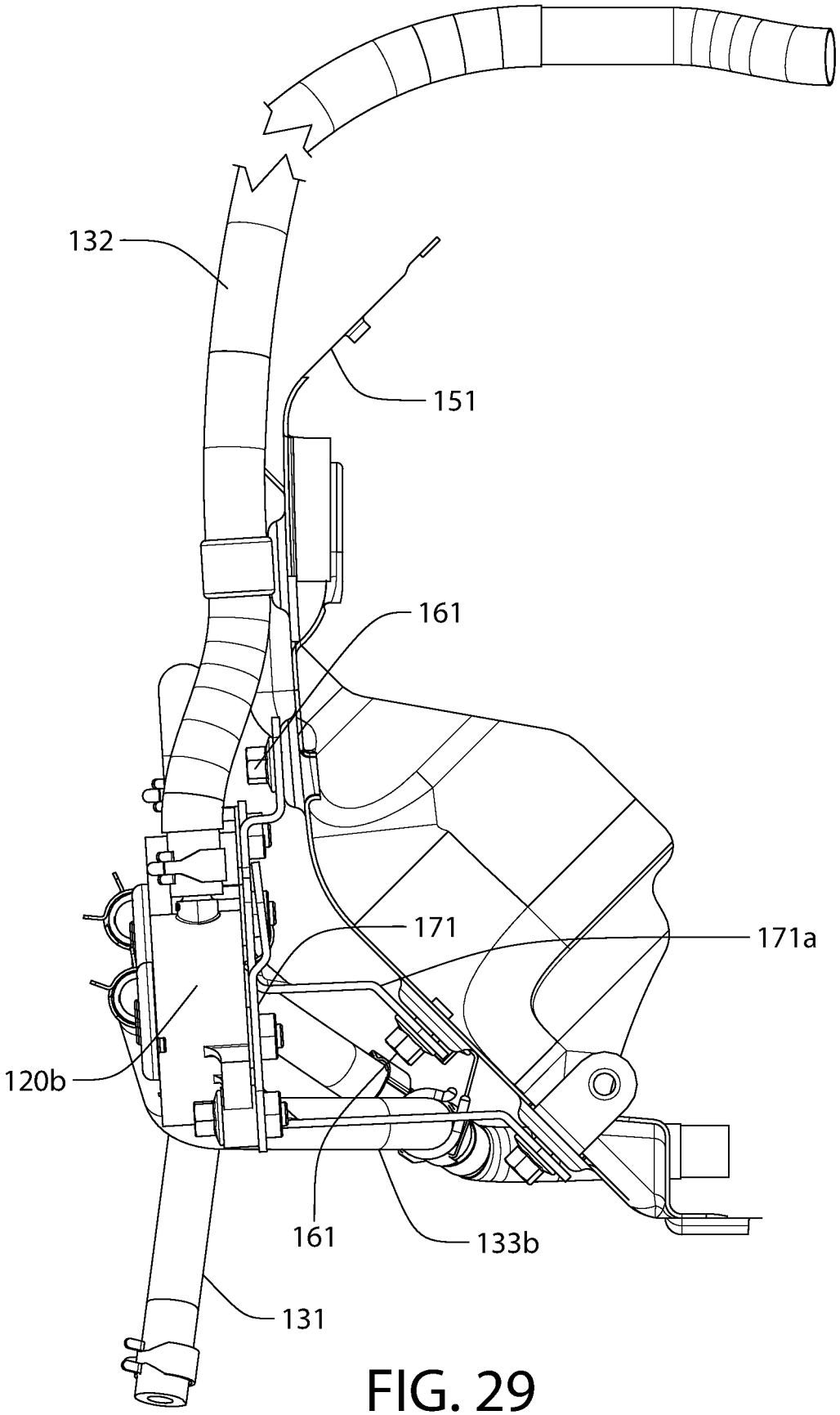
FIG. 29 is a first end view thereof.
Figure 30:
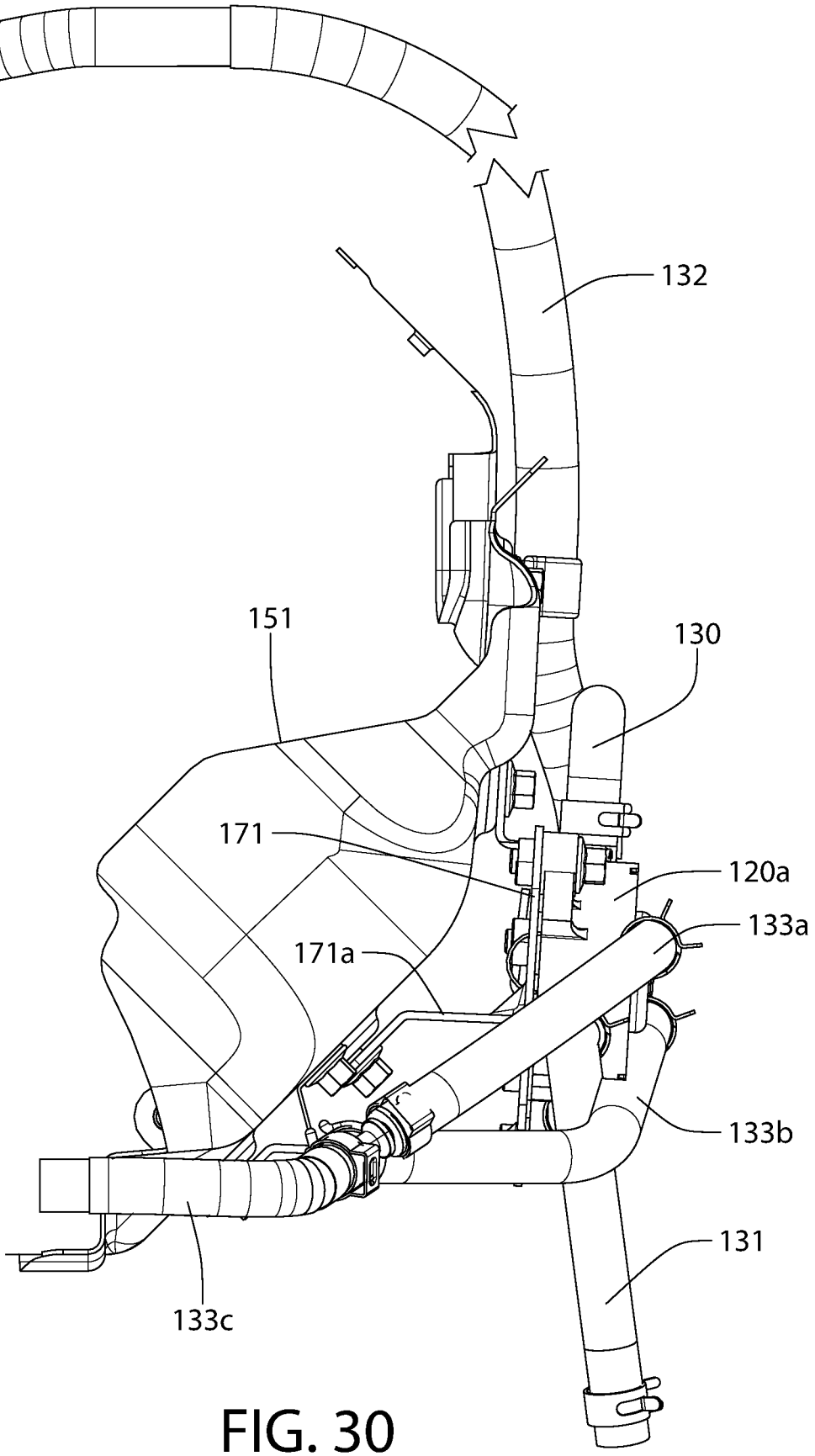
FIG. 30 is a second end view thereof.
Figure 31:
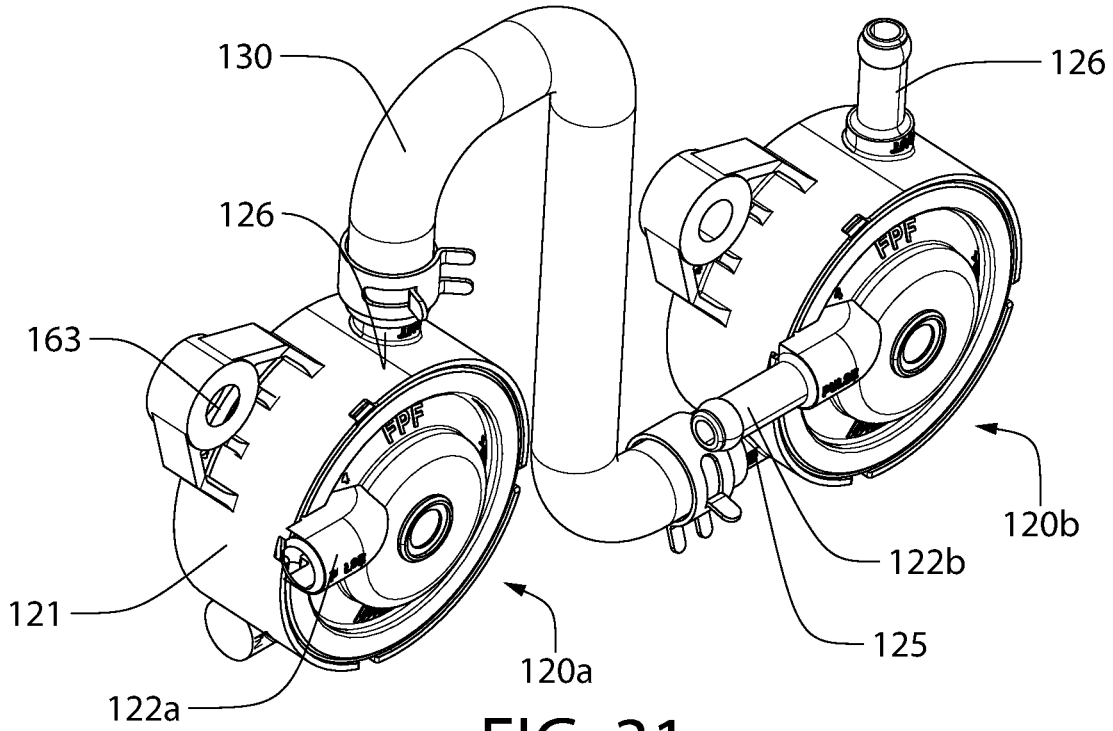
FIG. 31 is a first perspective view of the stacked fuel pumps in isolation and showing the inter-pump fuel connection.

FIGS. 20-32 depict a side-by-side mounting arrangement 170 usable for pulse pumps 120*a*, 120*b*. The pulse pumps are arranged in laterally spaced apart relationship such that each pump has a separate mounting axis MA1, MA2 each coaxially aligned with the respective centerline CL of each pump (see, e.g., FIG. 27). The mounting axes M1, M2 may be parallel to each other in one implementation.

Each pulse type fuel pump 120*a*, 120*b* may be separately and detachably mounted to a pump bracket 171 which in turn is mounted to the engine support surface 150 such as cylinder block baffle 151. Mounting fasteners 161 couple pumps 120*a*, 120*b* to bracket 171, and in some implementations may have a length sufficient to in turn mount the bracket to the baffle. Additional strap members 171*a* may be provided if needed to secure certain portions of the bracket 171 to the engine support surface 150 (e.g., cylinder block baffle 151). Any suitable configuration of pump bracket 171 may be used for mounting the side-by-side pump assembly 172 thereto. From a fuel flow path standpoint, the pumps in the side-by-side mounting arrangement 170 as still fluidly coupled together in series as shown (i.e. discharge from upstream pulse pump 120*a* is fluidly coupled directly to inlet of downstream pulse pump 120*b*).

Figure 18:
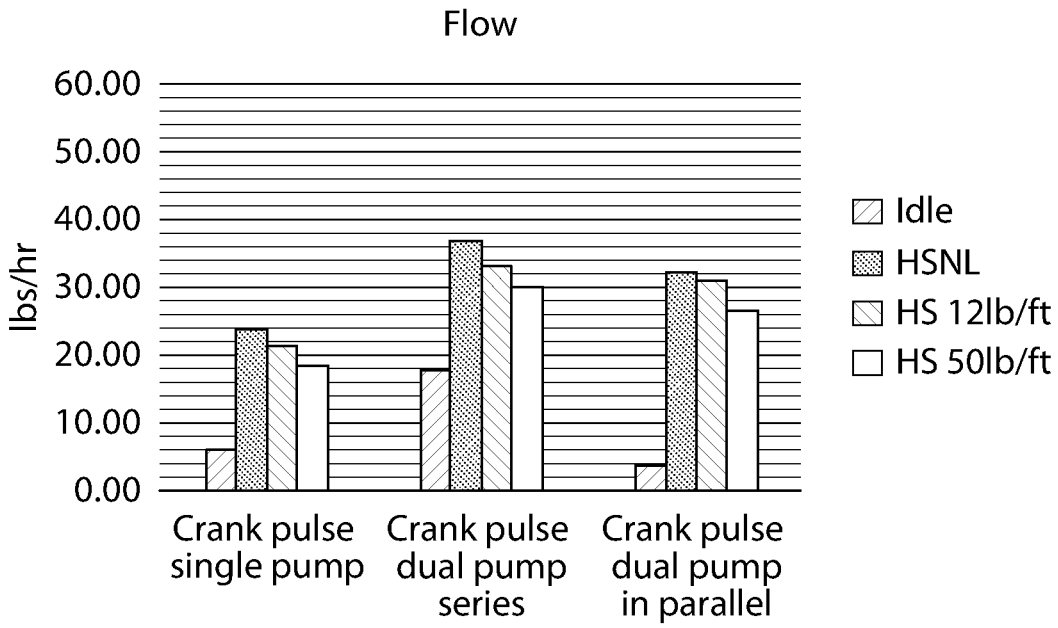
FIG. 18 is a graph showing the results of engine tests performed to measure fuel flow for various fuel pumps configurations and engine loads.
Figure 19:
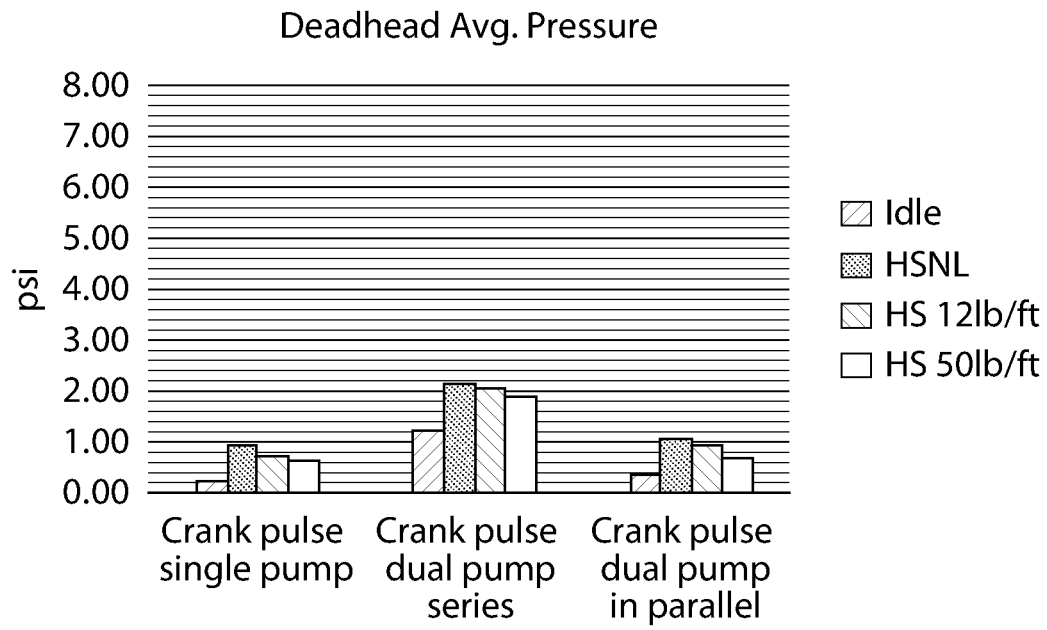
FIG. 19 is a graph showing the results of engine tests performed to measure deadhead average pressure for the same various fuel pumps configurations and engine loads of 18.
Figure 20:
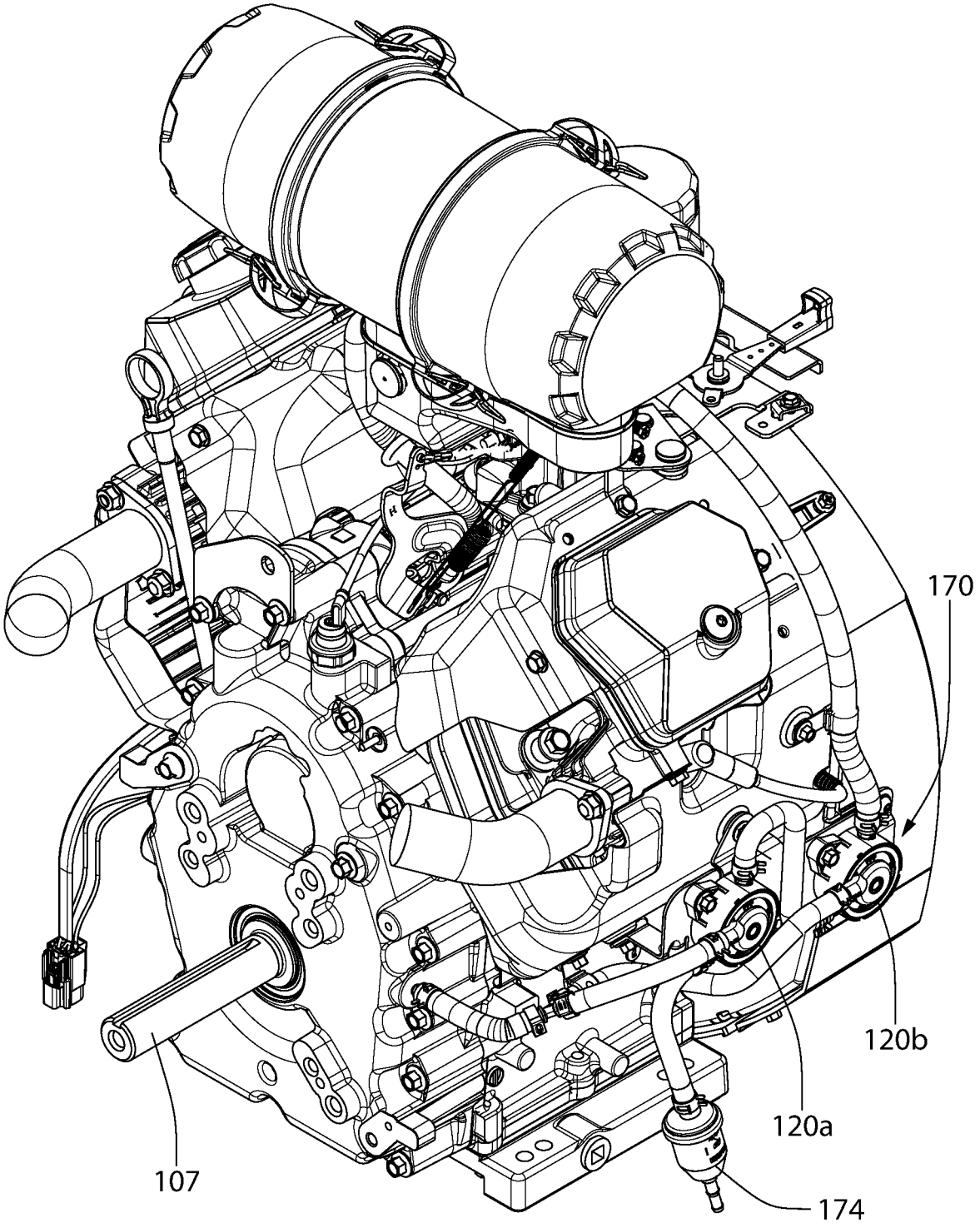
FIG. 20 is a perspective view of a second implementation of an internal combustion engine including the fuel supply system with the dual fuel pumps of FIG. 1, the pumps being mounted to an engine appurtenance in a side-by-side relationship to an engine appurtenance.
Figure 21:
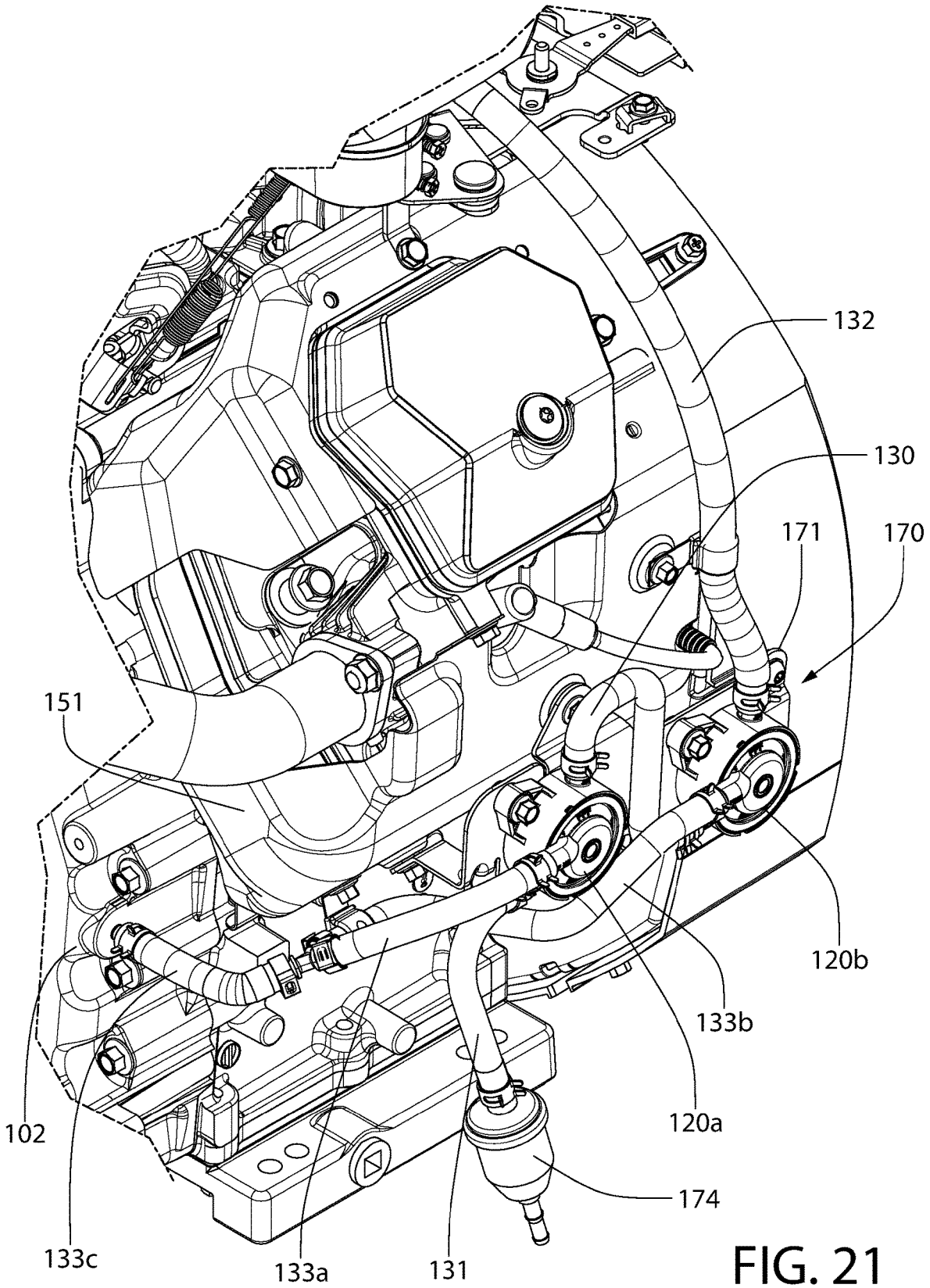
FIG. 21 is an enlarged detail taken from FIG. 20.

FIGS. 18-19 show the results of testing performed for the diaphragm-actuated fuel pulse pumps 120*a*, 120*b* fluidly coupled in series flow arrangement along the fuel flow path versus other configurations of the pulse pumps such as a pair of pulse pumps arranged instead in parallel flow and a single pulse pump. The fuel pump testing was at different engine load conditions including idling, high speed no load (HSNL), high speed (HS) 12 lb-ft. (pound-foot), and high speed (HS) 50 lb-ft. An engine dynamometer was used to apply load to the engine. Fuel flow was measured using volume flow over time by collecting the pump discharge in a graduate container. The tests used pulse type fuel pumps available from Walbro Engine Management of Tucson, Ariz. configured in the different flow arrangements noted in the graphs. A 40 HP four stroke/cycle Kohler engine was used for the tests. This type of engine is typically not amenable for use with single pulse type fuel pumps which cannot provide the fuel flowrate and pressures necessary for such engines.

The results of the flow measurement tests for the pulse pumps fluidly coupled in series flow shown in the Flow graph of FIG. 18 were unexpected. The series pulse pumps actually delivered more fuel flow at all engine load conditions than the parallel flow pump arrangement. Parallel pumps are generally used to produce greater flow at a given head (pressure). In other words, from a general fluids engineering standpoint, the flow produced by a pair of pumps arranged in parallel is determined by doubling the flow rate produced by a single pump at the same head. By contrast, pumps arranged in series flow are used to double the head (pressure) at a given flowrate.

In the engine tests above, the series pumps arrangement produced greater fuel flow rates at all engine load conditions than the parallel pumps which would have been expected to generate greater flow consistent with the conventional wisdom in the art. The test results for the series flow pulse pump were therefore not predictable. The tests demonstrated that pulse pumps could successfully be used in a fuel supply system to meet the fuel demands for large HP output, four stroke/cycle engines if fluidly coupled together in series flow arrangement as disclosed herein.

In the Deadhead Average Pressure graph of FIG. 19, the series pulse pump flow arrangement produced greater head (pressure) at all engine load conditions than a single pulse pump or pair of pulse pumps fluidly coupled together in a parallel flow arrangement.

While the foregoing description and drawings represent examples of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed examples are therefore to be considered in all respects as illustrative and not restrictive, the scope of the invention being defined by the appended claims and equivalents thereof, and not limited to the foregoing description or examples. Rather, the appended claims should be construed broadly, to include other variants of the invention, which may be made by those skilled in the art without departing from the scope and range of equivalents of the invention.

What is claimed is:

1. An internal combustion engine apparatus comprising:

a fuel reservoir;

a primary fuel supply path extending from a fuel inlet in fluid cooperation with the fuel reservoir to a fuel outlet;

a pressure pulse source;

first and second pressure-operated fuel pumps located along the primary fuel supply path, each of first and second pressure-operated fuel pumps operably coupled to the pressure pulse source, the first pressure-operated fuel pump comprising a first fuel inlet port and a first fuel outlet port, the second pressure-operated fuel pump comprising a second fuel inlet port and a second fuel outlet;

the first and second pressure-operated fuel pumps arranged in series along the primary fuel supply path such that fuel discharged by the first pressure-operated fuel pump is supplied to the second pressure-operated fuel pump;

a first fuel supply conduit having a first end and a second end fluidly coupled to the first fuel inlet port of the first pressure-operated fuel pump;

a fuel filter operably coupled to the first end of the first fuel supply conduit, the fuel filter disposed within the fuel reservoir; and a second fuel supply conduit having a first end fluidly coupled to the first fuel outlet port and a second end fluidly coupled to the second fuel inlet port of the second pressure-operated fuel pump.

2. The internal combustion engine apparatus according to claim 1 wherein the pressure pulse source is a crankcase chamber.

3. The internal combustion engine apparatus according to claim 1 further comprising one or more pressure pulse conduits operably coupling the first and second pressure-operated fuel pumps to the pressure pulse source.

4. The internal combustion engine apparatus according to claim 3 wherein the one or more pressure pulse conduits are sloped downward so that liquid in the one or more pressure pulse conduits gravity drains back into the pressure pulse source.

5. The internal combustion engine apparatus according to claim 3 further comprising:

the first pressure-operated fuel pump comprising a first pressure pulse port, the one or more pressure pulse conduits fluidly coupled to the first pressure pulse port;

the second pressure-operated fuel pump comprising a second pressure pulse port, the one or more pressure pulse conduits fluidly coupled to the second pressure pulse port; and the one or more pressure pulse conduits being first and second pressure-operated fuel pumps oriented so that the first and second pressure pulse ports allow liquid within pressure chambers of the first and second pressure-operated fuel pumps to gravity drain out of the pressure chambers via the first and second pressure pulse ports respectively.

6. The internal combustion engine apparatus according to claim 3 wherein the one or more pressure pulse conduits comprise only one pressure pulse inlet in fluid cooperation with the pressure pulse source.

7. The internal combustion engine apparatus according to claim 1 further comprising a third fuel supply conduit having a first end fluidly coupled to the second fuel outlet port and a second end comprising the fuel outlet.

8. The internal combustion engine apparatus according to claim 1 wherein the first and second pressure-operated fuel pumps operate in-phase with one another.

9. The internal combustion engine apparatus according to claim 1 further comprising a horizontal or vertical drive crankshaft.

10. The internal combustion engine apparatus according to claim 1 further comprising:

one of a carburetor or a fuel injector pump; and wherein the fuel outlet is in fluid cooperation with the one of the carburetor or the fuel injector pump to deliver fuel thereto.

11. The internal combustion engine apparatus according to claim 1 wherein the first and second pressure-operated fuel pumps are identical to one another.

12. The internal combustion engine apparatus according to claim 1 further comprising:

an engine body; and the first and second pressure-operated fuel pumps supported directly or indirectly by the engine body in either a stacked arrangement or a side-by-side arrangement.

13. The internal combustion engine apparatus according to claim 12 wherein the first and second pressure-operated fuel pumps are supported directly or indirectly by the engine body to the engine body in a stacked arrangement; and wherein the first and second pressure-operated fuel pumps are spaced from one another by one or more spacers.

14. The internal combustion engine apparatus according to claim 1 further comprising:

the first pressure-operated fuel pump comprising a first fuel chamber, a first pressure chamber, and a first diaphragm separating the first fuel chamber and the first pressure chamber;

the second pressure-operated fuel pump comprising a second fuel chamber, a second pressure chamber, and a second diaphragm separating the second fuel chamber and the second pressure chamber;

each of first and second pressure chambers operably coupled to the pressure pulse source; and each of first and second fuel chambers forming a portion of the primary fuel supply path.

15. The internal combustion engine apparatus according to claim 14 wherein each of the first and second diaphragms are biased into a fuel expel state; and wherein the pressure pulse source produces vacuum pulses in the first and second pressure chambers that transition the first and second diaphragms from the fuel expel state to a fuel intake state.

16. The internal combustion engine apparatus according to claim 1 wherein a first portion of the primary fuel path extending from the fuel inlet to the first pressure-operated fuel pump has a first length; and wherein a second portion of the primary fuel path extending from the first pressure-operated fuel pump to the second pressure-operated fuel pump has a second length; and wherein the second length is less than the first length.

17. The internal combustion engine apparatus according to claim 16 wherein a third portion of the primary fuel path extending from the first pressure-operated fuel pump to the fuel outlet has a third length; and wherein the second length is less than the third length.

18. The engine apparatus according to claim 1 wherein an engine of the engine apparatus has a horsepower greater than 25 horsepower.

19. An internal combustion engine comprising:

an engine body;

a fuel reservoir;

a pressure pulse source;

first and second pressure-operated fuel pumps operably coupled to the pressure pulse source and configured to deliver fuel from the fuel reservoir to a carburetor or a fuel injector;

the first and second pressure-operated fuel pumps supported directly or indirectly by the engine body;

the first pressure-operated fuel pump comprising a first fuel chamber, a first pressure chamber, and a first diaphragm separating the first fuel chamber and the first pressure chamber;

the second pressure-operated fuel pump comprising a second fuel chamber, a second pressure chamber, and a second diaphragm separating the second fuel chamber and the second pressure chamber;

each of first and second pressure chambers operably coupled to the pressure pulse source; and each of first and second fuel chambers forming a portion of the primary fuel supply path.

20. An internal combustion engine comprising:

a fuel reservoir;

a crankcase chamber experiencing pressure pulses; and at least one pressure-operated fuel pump operably coupled to the crankcase chamber by one or more pressure pulse conduits, the one or more pressure pulse conduits sloped so that carryover oil carried into the one or more pressure pulse conduits drains by gravity back into the crankcase chamber.

* * * * *